United States Patent [19]

Law

[11] Patent Number: 5,076,333

[45] **Date of Patent: * Dec. 31, 1991**

[54] POUR SPOUT

[75] Inventor: Verl Law, Emmett, Id.

[73] Assignee: Vemco, Inc., Emmett, Id.

[ * ] Notice: The portion of the term of this patent subsequent to May 30, 2006 has been disclaimed.

[21] Appl. No.: 361,590

[22] Filed: May 30, 1989

Related U.S. Application Data

[63] Continuation-in-part of Ser. No. 27,014, Mar. 16, 1987, Pat. No. 4,834,151.

[51] Int. Cl.[5] ..... B65C 3/00; B65B 39/04

[52] U.S. Cl. ..... 141/198; 141/39; 141/291; 141/296; 141/302; 141/352; 141/335

[58] Field of Search ..... 141/192, 198, 193, 291, 141/292, 293, 294, 295, 296, 297-300, 301, 302, 305, 307, 308, 309, 351, 352, 353, 354, 357, 335, 344, 345, 39

[56] References Cited

U.S. PATENT DOCUMENTS

| | | | |
|---|---|---|---|
| 245,401 | 8/1881 | Raynor et al. | 141/353 |
| 525,744 | 9/1894 | Roth | 141/353 |
| 1,820,197 | 8/1931 | McGhee et al. | 141/292 X |
| 2,154,583 | 4/1939 | Rodgers | 141/292 |
| 2,341,950 | 2/1944 | Schepps | 141/387 |
| 2,445,130 | 7/1948 | Turner | 141/305 X |
| 2,593,634 | 4/1952 | Vosburg | 222/514 |
| 2,681,759 | 6/1954 | Risser | 141/293 |
| 2,701,078 | 2/1955 | Bowman | 222/117 |
| 2,743,047 | 4/1956 | Clarke | 141/293 X |
| 3,005,475 | 10/1961 | Beall, Jr. | 141/198 |
| 3,207,190 | 9/1965 | Silbereis et al. | 141/198 |
| 3,263,711 | 8/1966 | Laub | 141/40 |
| 3,289,712 | 12/1966 | Smith | 141/295 |
| 3,540,402 | 11/1970 | Kocher | 141/198 |
| 3,595,281 | 7/1971 | Laub | 141/46 |
| 3,994,323 | 11/1976 | Takahata et al. | 141/302 |
| 4,314,657 | 2/1982 | Perakis et al. | 222/162 |
| 4,598,743 | 7/1986 | Milling | 141/296 |
| 4,667,710 | 5/1987 | Wu | 141/198 |
| 4,834,151 | 5/1989 | Law | 141/198 |

FOREIGN PATENT DOCUMENTS

| | | | |
|---|---|---|---|
| 1179560 | 5/1959 | France | 141/335 |
| 368214 | 3/1932 | United Kingdom | 141/335 |
| 1569872 | 6/1980 | United Kingdom | 141/351 |

*Primary Examiner*—Ernest G. Cusick

*Attorney, Agent, or Firm*—Workman Nydegger Jensen

[57] ABSTRACT

A fluid conduit formed of a hollow tube attached at one end to a container of fluid is provided at the other end with an end cap in which is formed a fluid discharge opening through which to transfer fluid. A slide valve on the exterior of the conduit is biased into a closed position, precluding fluid transfer until the discharge opening is inside a receiving vessel. An air vent tube within the conduit communicates between the interior of the container and the exterior of the fluid conduit and admits air into the container to facilitate even-flowing transfers after the transfer of an initial quality of fluid without the admission of air into the container reduces the air pressure therein sufficiently below ambient pressure to curtail further fluid transfer. Fluid filling a receiving container closes entry to the air vent tube when the receiving vessel is filled, terminating air flow into the container and stopping fluid flow through the conduit. The air vent tube includes one or more capillary sections of reduced inner diameter relative that of the air vent tube. A seal is provided for closing entry to the air vent tube when the slide valve is in its closed position, and a relief passageway with a one-way valve communicates between the air tube and the exterior of the fluid conduit to permit fluid to drain from the vent tube following each fluid transfer.

58 Claims, 8 Drawing Sheets

POUR SPOUT

RELATED APPLICATION

This is a continuation-in-part application of U.S. patent application Ser. No. 27,014 filed on Mar. 16, 1987 in the name of Verl Law for an invention entitled "Pour Spout," which issued on May 30, 1989 as U.S. Pat. No. 4,834,151.

BACKGROUND OF THE INVENTION

1. Field of the Invention

This invention relates to pour spouts for containers of fluid, and more particularly to pour spouts which permit transfers of fluid under the influence of gravity into a receiving vessel without the risk of spillage or overflow.

2. Background Art

The instances are numerous in which a receiving vessel or tank must be filled with a fluid and the environment in which this is accomplished or the nature of the fluid itself demands that spillage be minimized or totally eliminated.

A common example involves the widespread use of internal combustion engines in lawnmowers, chain saws, tractors, motorized recreational vehicles, outboard motors, and other gasoline-powered machinery employed on farms and construction sites. It is undesirable that in filling the fuel reservoirs for such devices gasoline in any appreciable quantity should be spilled. Uncontained gasoline presents health and safety risks to persons nearby, as well as a source of environmental pollution generally. Associated with other fluids, such as cooking or machine oils, pesticides, fertilizers, cleaning fluids, sealants, and even food substances are similar concerns for minimizing spills when fluids are transferred from one container to another.

In such fluid transfers, the opportunity for spills have several causes. First, where the opening into the receiving vessel is narrow, it is often the case that a stream of fluid directed thereinto will, either due to its size or the unsteady hand of the pourer, stray outside of that opening. Where no facilitating pour spout or funnel is employed and the exit of the container of fluid never actually enters the opening to the receiving vessel, this problem is a continuing one throughout the entire pouring process.

Second, containers of fluid, whether or not equipped with facilitating pour spouts or used with funnels, must be tilted toward the receiving vessel in order to initiate a flow of fluid. When this tilting must occur prior to entry of the pour spout into the neck of the receiving vessel or the top of the funnel, spillage is common.

In addition, many spills occur when the receiving vessel to which fluid is being transferred fills and overflows before pouring can be terminated. Such a situation is extremely common in receiving vessels having narrow-necked openings. In such structures, it is difficult for the pourer to visually verify the level of fluid in the receiving container as pouring is occurring. Also, once fluid in the receiving vessel reaches the level of the intake neck of the receiving vessel, additional incoming fluid, rather than being received in the volume of the entire receiving vessel, fills into only in the intake neck thereof. This results in an abrupt increase in the rate of rise in the level of fluid, enhancing the likelihood of an overflow.

A final source of difficulty in controlling transferred fluids to prevent waste and spilling is that frequently the container from which the fluid is being poured is not effectively vented during the pouring process. This can result in an uneven flow of fluid, and even surges of flow which render impossible a reliable prediction of the level of the fluid in the receiving vessel. Surges of fluid flow can also cause splashing. If occurring when the receiving vessel is almost full such surges will certainly cause overflows. In addition, the turbulence created by such surges of flow in the container from which fluid is being poured can shift the weight of that container making it difficult to hold steady.

A further problem related to ineffective venting during pouring is the development of an airlock wherein a total absence of venting in combination with specific volume and viscosity parameters can result in a fluid which will not pour once its container is inverted. On occasion the air lock can be dissipated by righting the container, but such activity causes splashing of the fluid in its container, and the necessity to reenter the pour spout into the receiving vessel thereafter only increase the opportunities for spills.

While a funnel or a narrow-necked pour spout on a fluid container can to a degree reduce spills, such devices without more do not adequately eliminate spills arising due to all of the causes described above. This is particularly true in relation to overflow control in the type of fluid transfers in which fluid flows from a container into a receiving vessel under the influence of gravity exclusively, rather than under circumstances in which pumping motivates motion in the transferred fluid.

The overflow control mechanisms commonly used in service stations for controlling overflow in filling the gas tank of a vehicle are of this latter type. They derive their effectiveness from the fact that the fluid transferred is being moved due to pressure, rather than gravity. By contrast, only gravity is used, for example, to induce the flow of kerosene when that fuel is transferred from a storage container at a campsite into a lantern or a cookstove. It is to such gravity-induced types of fluid transfers that the present invention pertains, and it has been found that prior to this invention, no known satisfactory configuration for a pour spout had been achieved which could consistently facilitate spill-free, clean fluid transfers.

SUMMARY OF THE INVENTION

One object of the present invention is to produce a pour spout for a container of fluid which will preclude the overflow of any receiving vessel into which that fluid is transferred.

Another object of the present invention is to produce such a pour spout which is conducive to a uniform, evenflowing of fluid into the receiving vessel, a fluid flow lacking surges which could splash fluid out of the receiving vessel or override the effects of an otherwise operable overflow prevention system.

Still another object of the present invention is to produce a pour spout such as that described above which eliminates spills of the fluid being transferred when the container from which it is to be poured has been inverted, but has not yet been received within the opening to a receiving vessel.

It is yet an additional object of the present invention to make available for the benefit of the public a pour spout as described above which precludes the formation in an upturned container of fluid of any air lock which could interfere with the initiation of fluid flow.

Yet another object of the present invention is to produce a pour spout as described above that is efficient to manufacture.

The cumulative purpose of all the above-described objects of the present invention is to produce a pour spout permitting transfers from a container of fluid to a receiving vessel under circumstances which minimize the opportunities for spills or losses of fluid. It is the objective of the present invention to accomplish this in an environment in which the impetus for fluid flow is gravity exclusively.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a pour spout for permitting transfers from a container of fluid to receiving vessel is provided in one embodiment of the invention comprising a fluid conduit attached at one end thereof to the container of fluid. The fluid conduit is provided at a location remote from the container with a fluid discharge opening through which fluid is transferred from the fluid conduit into the receiving vessel. In one embodiment of the present invention, the fluid conduit comprises a conduit tube and a fluid conduit end cap in which is formed the fluid discharge opening and a discharge passageway communicating therewith from the interior of the fluid conduit. A first end of the tube opens into the container, while the end cap is attached to and at least partially closes the second end. The discharge opening and discharge passageway are so configured that fluid transferred through the discharge opening is imparted a substantial component of momentum away from the container parallel to the longitudinal axis of the conduit.

The pour spout further comprises closure means for precluding any flow of fluid from the fluid conduit until the fluid discharge opening is inside the receiving vessel. Preferably the closure means comprises a slide valve urged into a closed position and a slide valve release means for coacting with the receiving vessel to open the slide valve and permit fluid to flow from the fluid conduit through the fluid discharge opening when the fluid conduit is inserted into the receiving vessel. In one embodiment, the slide valve comprises a sleeve closely conforming to the exterior surface of the fluid conduit mounted thereon for sliding motion thereupon, a valve seat on the fluid conduit on the side of the fluid discharge opening remote from the container of fluid, and bias means for urging the sleeve along the fluid conduit into sealing arrangement with the valve seat. The valve seat may comprise a resilient seal, such as an O-ring or a lathe-cut seal, encircling the fluid conduit.

In addition, the invention includes a venting means for admitting air into the interior space within the fluid conduit and the container to enable an even-flowing transfer of fluid from the container. This occurs after an initial transfer of the fluid through the discharge opening without admitting air into the interior space reduces the pressure of the air in the interior space sufficiently below atmospheric pressure to substantially curtail continued transfer of fluid through the discharge opening. At this point, substantial back pressure counteracting the outward flow of fluid has been created in the container, but the venting means begins to admit air into the interior space, so that continued transfer of the fluid can occur. The air flow into the interior space through the venting means terminates when the receiving vessel becomes filled with the fluid. Due to the back pressure in the container, this effects a prompt curtailment of the continued transfer of fluid.

The venting means preferably comprises an air vent tube communicating between the exterior of the fluid conduit and the interior space within the fluid conduit and the container of fluid, in combination with an air vent tube constriction means for retarding the entry of fluid into the air vent tube when fluid is being transferred from the container. In this manner a column of air is advantageously retained in the air vent tube during the transfer of fluid. The air vent tube constriction means may comprise one or more spaced-apart capillary sections in the air vent tube having inside diameters less than that of the air vent tube itself.

In one embodiment of the inventive pour spout, the air vent tube is disposed within the fluid conduit, so as to communicate with an air vent opening formed in the fluid conduit at a position which is inside the receiving vessel when the sleeve is drawn out of sealing engagement with the valve seat by the coaction of the slide valve release means with the receiving vessel. The air vent opening may be formed in the end cap of the fluid conduit together with one of the capillary sections of the air vent tube construction means.

In another aspect of the present invention, a seal is provided at the air vent opening for closing the air vent opening when the slide valve is in its closed position. The seal comprises a pivotally mounted lever having a closed position blocking the air vent opening. A bias means urges the lever out of its closed position, while a closure means on the lever forces the lever into its closed position when the slide valve is in its own closed position. The air vent opening and the elements of the seal thereat may advantageously be located in a recess formed in a side surface of the end cap of the fluid conduit.

The venting means may also comprise a relief means for draining fluid from the air vent tube after each transfer of fluid from the container thereof. In one embodiment of the invention, the relief means comprises a relief passageway communicating between the air vent tube and the exterior of the fluid conduit and an umbrella valve located in the relief passageway for that admits air into the air vent tube when the air pressure therein is less by a predetermined amount than ambient air pressure. The relief passageway and a chamber for housing the umbrella valve may be formed in the end cap of the fluid conduit.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity in detail through the use of the following drawings in which.

DESCRIPTION OF THE PREFERRED EMBODIMENT

Figure 1:
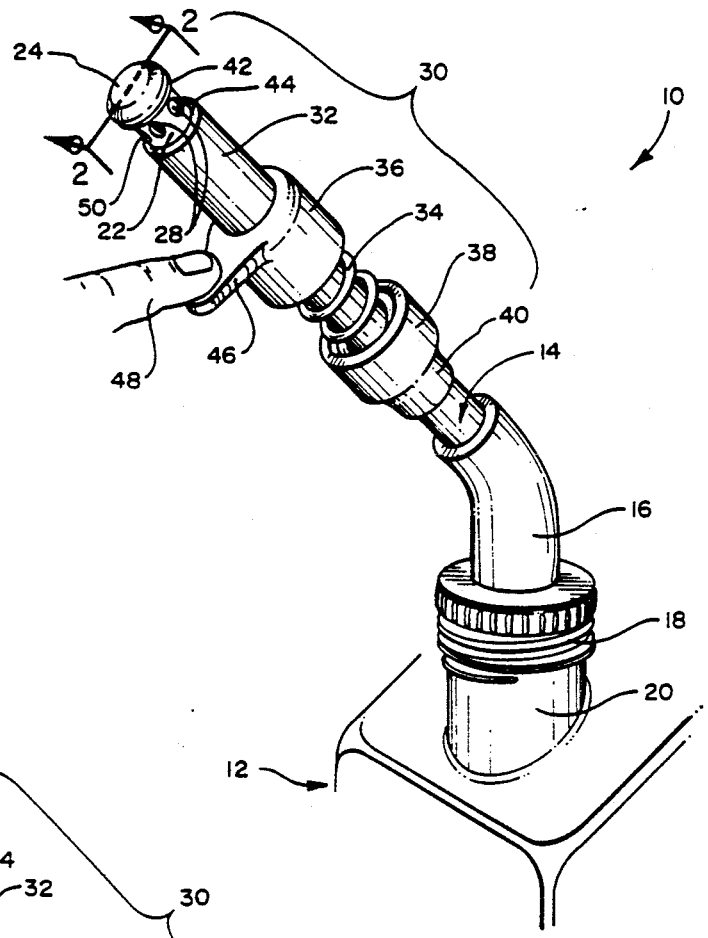
FIG. 1 is a perspective view of one embodiment of a pour spout incorporating the teachings of the present invention.
Figure 2:
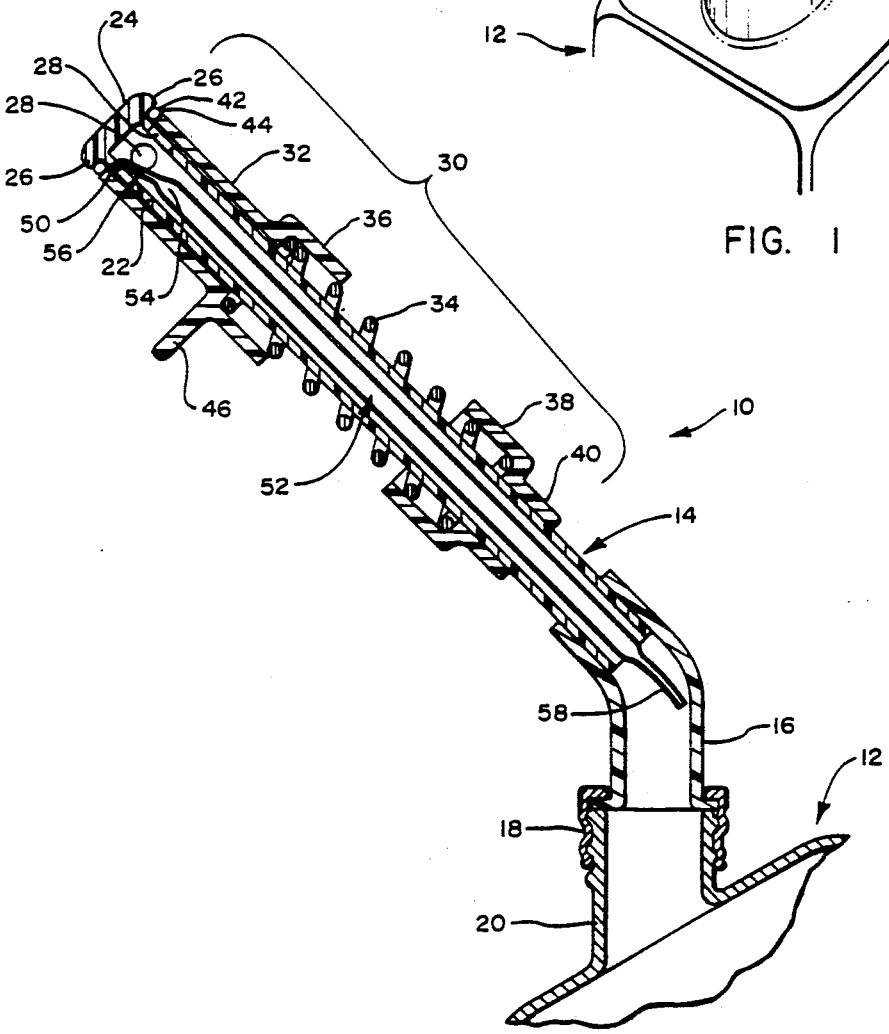
FIG. 2 is a cross-sectional view of the embodiment of the pour spout illustrated in FIG. 1 taken along the section line 2—2 therein.

FIGS. 1 and 2 taken together illustrate one embodiment of a pour spout 10 constructed according to the teachings of the present invention for permitting transfers from a container of fluid 12 while minimizing the possibility of spillage and waste of that fluid. Pour spout 10 comprises a fluid conduit 14 having one end 16 thereof attached to container 12. As used herein, the term "fluid conduit" will be used to refer to any structure, such as fluid conduit 14, through which fluid is transferred from a container, whether or not the fluid conduit is comprised of one or several components, and whether or not the passageway for fluid therethrough is straight, or as in FIGS. 1 and 2, bent at one or more portions thereof.

Pour spout 10 may be fabricated with container 12 as an integral, nonremovable portion thereof by the permanent attachment of end 16 of fluid conduit 14 to container 12. Alternatively, and as shown in FIGS. 1 and 2, pour spout 10 may be removably attached to a container, such as container 12, by any known structure capable of effecting that result. In FIGS. 1 and 2 this is shown to be possible using an annular, threaded cap 18 which cooperates with a correspondingly threaded neck portion 20 of container 12 to retain end 16 of fluid conduit 14 in selectively removable, fluidsealing engagement therewith.

In pour spout 10 the extreme end 22 of fluid conduit 14 terminates in a laterally disposed end piece 24 which extends radially outward beyond the exterior of fluid conduit 14 in an overhanging circular lip 26, the function of which will be explained subsequently. At a location on fluid conduit 14 remote from container 12 one or more fluid discharge openings 28 are formed for permitting fluid to exit from fluid conduit 14. In most applications contemplated fluid discharge openings 28 will preferably be located near the extreme end 22 of the fluid conduit in which they are formed.

In accordance with one aspect of the present invention, closure means are provided for precluding any flow of fluid from a fluid conduit, such as fluid conduit 14, until the fluid discharge openings through which such fluid can emerge are inside the receiving vessel to which the fluid is being transferred. As shown in FIGS. 1 and 2 by way of example and not limitation, a slide valve 30 located on conduit 14 is biased into a closed position in which the flow of fluid from fluid conduit 14 through fluid discharge openings 28 is precluded. Slide valve 30 may admit of many alternate configurations, but that presently preferred for the purposes of the inventive pour spout, is shown disposed on the exterior of fluid conduit 14.

Slide valve 30 comprises a sleeve 32 closely conforming to the exterior surface of fluid conduit 14 and mounted for sliding motion thereupon. In a fluid conduit 14 dimensioned so as to have an inner diameter of approximately 0.50 inches, a difference in diameter between the outside of fluid conduit 14 and the inside of the slide valve sleeve 32 which is in the range of 0.002 to 0.003 inches has been found to be a workable clearance satisfying the several functional demands placed upon sleeve 32. Not the least of these demands is that sleeve 32 must slide freely upon fluid conduit 14 and have an adequate longitudinal dimension so as to preclude binding thereupon.

Sleeve 32 is urged along fluid conduit 14 in a direction away from container 12 by a bias means, which by way of illustration, is shown in FIGS. and 2 as a spring 34 disposed encircling fluid conduit 14. Spring 34 is held in compression between an enlarged cylindrical spring retainer 36 at the end of sleeve 32 closest to container 12 and a similarly shaped, opposed spring retainer 38 at the facing end of a collar 40 rigidly attached to fluid conduit 14 at a longitudinally fixed point thereupon. In this manner, spring 34 urges sleeve 32 along fluid conduit 14 in a direction away from container 12. Movement of sleeve 32 off extreme end 22 of fluid conduit 14 is blocked by lip 26 of end piece 24, which functions as the valve seat for slide valve 30. When sleeve 32 is against lip 26, spring 34 is in its state of longest extension but is still in a state of relative compression. To enhance the sealing effect of slide valve 30, a resilient O-ring 42 may be retained encircling fluid conduit 14 between lip 26 and fluid discharge openings 28. The leading edge 44 of sleeve 32 then is forced into sealing engagement with O-ring 42 by spring 34 in the closed position of slide valve 30. With slide valve 30 in its closed position, fluid discharge openings 28 are blocked, precluding any flow of fluid from fluid conduit 14 until the biasing effect of spring 34 is overcome.

In accordance with yet another aspect of the invention, the closure means partially described above is further provided with a slide valve release means for coacting with a receiving vessel for fluid from container 12 in order to open slide valve 30 and permit fluid to flow from fluid conduit 14 through fluid discharge openings 28 which are otherwise blocked by the slide valve in its closed position. By way of example, a simple form of such a slide valve release means can be seen in FIGS. 1 and 2 to comprise a projection 46 secured to sleeve 32 for catching the lip of a receiving vessel when pour spout 10 is inserted thereinto. As pour spout 10 is advanced into the receiving vessel, sleeve 32 is drawn out of engagement with its valve seat, in this instance with O-ring 42. It is thus the relative motion between a container of fluid, such as container 12, and the inlet to a receiving vessel that serves to open slide valve 30 and permit fluid flow through pour spout 10.

FIG. 1 illustrates the relationship of the parts of pour spout 10 when such relative a motion has overcome the bias of spring 34 and sleeve 32 is no longer in the closed position of slide valve 30. In the instance illustrated in FIG. 1, however, the force upon projection 46 necessary to effect such a result is being applied by a finger 48 of an operator. The same operation is nevertheless effected when end 22 of fluid conduit 14 is moved into a receiving vessel so that projection 46 coacts therewith. Such operation will be described in detail subsequently. In FIG. 2, finger 48 of an operator has been removed from projection 46, and slide 32 can there be seen to be again urged into the closed position of slide valve 30.

In accordance with yet another aspect of the invention, a pour spout, such as pour spout 10, is provided with venting means for admitting air into the interior space within the fluid conduit of the pour spout and the container of fluid with which it is employed to facilitate an even-flowing transfer of fluid from the discharge opening. Preferably, the venting means operates in this manner only after an initial transfer of fluid through the discharge opening without admitting air into the interior space reduces the pressure of air in the interior space sufficiently below atmospheric pressure to substantially curtail continued transfer of fluid through the discharge opening. Thereafter, this back pressure continues to be maintained, but the venting means by admitting air into the interior space allows for an even-flowing transfer of fluid thereafter. When the receiving container becomes filled with fluid, the venting means terminates the flow of air into that interior space. This in combination with the back pressure in the container created before air flow commenced into the interior space, promptly curtails the flow of fluid through the pour spout, effecting automatic overflow protection.

By way of illustration, and not limitation, one embodiment of such a venting means for use with a pour spout according to the present invention is best seen in FIG. 2 to comprise an air vent opening 50 formed in fluid conduit 14 and an air vent tube 52 preferably disposed within fluid conduit 14 communicating at one end 54 thereof with air vent opening 50. While air vent tube 52 is shown in FIG. 2 as being entirely disposed within fluid conduit 14, such an arrangement is merely preferred, but not essential, to the satisfactory functioning of the inventive pour spout.

Air vent opening 50 is so located on fluid conduit 14 so as to be within a receiving vessel whenever sleeve 32 is drawn out of sealing engagement with its corresponding valve seat by the coaction of projection 46 with the receiving vessel. Under most circumstances envisioned this would require that air vent opening 50 be in relatively close longitudinal proximity on fluid conduit 14 to fluid discharge openings 28. While such a relative relationship among air fluid discharge openings 28 and vent opening 50 is illustrated in FIGS. 1 and 2, alternate arrangements are workable. For example, air vent opening 50 could be more remote or more proximate to a container of fluid, such as container 12, than are fluid discharge openings 28. The implication of this variable aspect of the invention will become clear when the operation thereof is described below. For the present, however, it suffices to indicate that one function of air vent tube 52 is to admit air into the interior space within fluid conduit 14 and container 12 to facilitate an even-flowing transfer of the fluid out of container 12 through pour spout 10.

The venting means suitable for use with a pour spout, such as pour spout 10, further comprises an air vent tube constriction means for retarding the entry of fluid into air vent tube 52 when fluid is being transferred from the pour spout. This results in retaining a column of air in air vent tube 52 during each transfer of fluid from pour spout 10. The utility of this result will be described subsequently. As fluid initially is transferred from container 12 through pour spout 10 without air entering container 12 through air vent tube 52, the pressure of the air in the interior space in container 12 and pour spout 10 is reduced to less than the ambient pressure of the atmosphere outside of container 12. Thereafter, while the interior space becomes vented through air vent tube 52, the back pressure is maintained within container 12 and assists in the fluid flow curtailment function of the venting means.

As shown in FIG. 2, with additional specificity, but by no means by way of limitation, such an air vent tube constriction means comprises at least one capillary section in air vent tube 52 having an inside diameter less than that of air vent tube 52. In FIG. 2, two such capillary sections 56, 58 are shown integrally formed in air vent tube 52. Capillary section 56 is located at air vent opening 50, while capillary section 58 is located at the end of air vent tube 52 remote therefrom. For optimum functioning of the air vent means of the present invention in all its diverse aspects, it is desirable that the inside diameter of capillary sections 56, 58 be substantially identical. Capillary sections 56, 58 need not, however, be of equal length to ensure optimum functioning of the device. While capillary sections 56, 58 are shown in FIG. 2 as separated from each other, a suitable airflow constriction means is conceivable for specific combinations of fluid viscosity and lengths of an air vent tube as would require the capillary portions to encompass the entire length of the air vent tube.

Figure 3A:
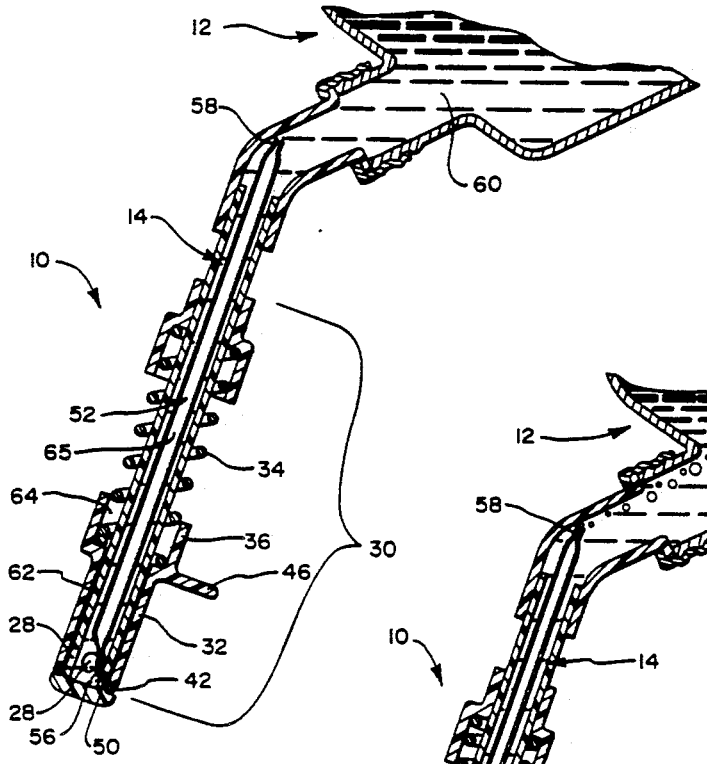
FIG. 3A is a cross-sectional view of the pour spout shown in FIG. 1 in a first stage of operation.

The operation of a pour spout according to the present invention, such as pour spout 10, will now be described in detail in relation to FIGS. 3A, 3B, and 3C in sequence. In FIG. 3A, container 12 holding a reservoir of fluid 60 has been upturned in preparation for transferring a portion of fluid 60 into a receiving vessel. Fluid 60 thus fills the portion of fluid conduit 14 exterior to air vent tube 52. Due to the action of spring 34, sleeve 32 is in the closed position of slide valve 30 urged against O-ring 42, and fluid 60 is in theory precluded from escaping through fluid discharge openings 28 by the inner surface of sleeve 32.

In actual fact, however, unless the fit between sleeve 32 and fluid conduit 14 is exact, a condition which could be predicted to preclude easy sliding of sleeve 32 on fluid conduit 14, fluid does seep through fluid discharge openings 28 into the interstitial space 62 between sleeve 32 and the outer surface of fluid conduit 14. The seepage of fluid 60, is nevertheless sufficiently slow due to the close fit between sleeve 32 and the outer surface of fluid conduit 14 as to adequately serve the purposes of the pour spout 10. For the clearances described already, inverted positioning, such as that shown in FIG. 3A, for a period of approximately thirty seconds would be required until seepage of fluid 60 filled all of interstitial space 62, as well as the cup-like space 64 within spring retainer 36. By that point in time, however, further operation of pour spout 10 will normally have occurred, eliminating any fluid 60 within interstitial space 62. In addition to permitting sleeve 32 to slide upon fluid conduit 14, interstitial space 62 permits the venting of container 12 when stored in its upright position, thereby preventing an dangerous buildup of pressure therewithin.

When container 12 is inverted, fluid initially flows through discharge openings 28, creating a back pressure in container 12 in the space 72 above fluid 60. No air flows through air vent tube 52 for relieving the developing back pressure until such time as that back pressure is sufficiently less than atmospheric pressure to curtail any continued transfers of fluid from fluid drainage discharge 28. At this point, the negative pressure in space 72 is approximately equal to the fluid head pressure developed between the top surface of fluid 60 and fluid discharge openings 28. Under such circumstances, air will begin to enter through air vent tube 52 to permit a continued even-flowing transfer of fluid 60. An arrangement of equipment for demonstrating this sequence of events will be described subsequently.

If air vent opening 50 is located relatively close to the end of fluid conduit 14, then fluid 60 seeping through fluid discharge openings 28 into interstitial space 62 will promptly enter air vent opening 50 and fill capillary section 56 of end 54 of air vent tube 52. This will prevent any air entrapped in air vent tube 52 when container 12 is inverted from escaping through air vent opening 50. The fluid head at the open end of capillary section 58 present due to the reservoir of fluid 60 housed in container 12 in combination with the reduced inner diameter of capillary section 58 will prevent the escape of air from air vent tube 52 through the end thereof remote from air vent opening 50. The result will be a static condition in which an air column 65 is trapped in air vent tube 52 awaiting the next phase of pour spout operation.

The effect of column 65 trapped in air vent tube 52 is critical in two respects to ensuring the prompt flow of fluid during the next stage of operation, when slide 32 is retracted by the coaction of projection 46 with the opening to the receiving vessel for fluid 60. First, column 65 trapped in air vent tube 52 prevents air vent tube from filling up with fluid 60, which would seriously undermine the ability air vent tube 52 to admit air into the interior space within fluid conduit 14 and container 12. Were air vent tube 52 to fill with fluid 60, like the rest of fluid conduit 14, the fluid head pressure at air vent opening 52 due to the reservoir of fluid 60 thereabove in container 12 would be equal to the fluid head pressure at fluid discharge openings 28. With no differential in head pressure between the fluid discharge openings 28 and the air vent opening 50, no air could enter container 12 to relieve back pressure on fluid 60 even with sleeve 32 retracted. Fluid 60 would not flow, or if it did so, flow would commence on an unpredictable basis.

Most individuals are familiar with the phenomenon in which an upturned full bottle of catsup will not permit its contents to emerge. Those contents are normally freed either by shaking the bottle, which imparts to the contents thereof adequate momentum to overcome the back pressure created in the top of the bottle by their escape, or by venting the top of the bottle so that air may be exchanged volume-for-volume by any catsup that does pour out. The latter is usually accomplished by tilting back the bottle to one side to permit an air passageway to the interior of the bottle to develop along the upper surface of the neck of the bottle. Under circumstances contemplated for fluid transfers with the inventive pour spout, however, neither shaking nor back tilting are considered acceptable means for initiating the flow of fluid.

The contents of a bottle of catsup that cannot be extracted due to an air lock condition such as that described above, could alternatively be made to flow, if a thin venting tube were extended through the mouth of the inverted bottle and the catsup to the air space within the bottle thereabove. Nevertheless, were this venting tube to be filled with catsup, the bottle would still not be provided with the venting action required to initiate catsup flow. The fluid head in the filled venting tube and outside it in the filled bottle neck would be equal. Only a differential between the fluid pressure at the open end of the bottle and the exposed end of the venting tube could commence the flow of catsup. Suction or air pressure at one or the other of these two locations would be required to overcome the static condition of the fluid. Otherwise, the user would merely have to be content to wait until some shift in the fluid stasis were to occur, breaking the air lock in the bottle.

In the inventive pour spout, by contrast, air column 65 trapped in air vent tube 52 prevents such venting dysfunctions. The air column 65 creates a head pressure differential between fluid discharge openings 28 and air vent opening 50 due to the difference in head pressure created by air column 65 and the corresponding column of fluid 60 in fluid conduit 14 outside air vent tube 52. The head pressure at fluid discharge openings 28 in the static position depicted in FIG. 3A is that arising due to the full height of the fluid 60 standing above fluid discharge openings 28. On the other hand, the head pressure at air vent opening 50 is in substance equal only to the head pressure developed by the amount of fluid 60 standing above capillary section 58 at the end of air vent tube 52 remote from air vent opening 50.

This is because within air vent tube 52, between capillary section 58 and capillary section 56, no column of fluid 60 is present. Air column 65 adds a negligible amount of head pressure to that exerted on the small quantity of fluid closing capillary section 54 at air vent opening 50. Thus, the head pressure at capillary section 52 is equal to that exerted at capillary section 58, which is transmitted thereto through the compressible air column 65. As the head pressure in fluid 60 at capillary section 58 will always be less than head pressure appearing at fluid discharge openings 28 at the far end of fluid conduit 14, the opening of slide valve 30 will result in fluid flow, promptly, consistently, and continuously through fluid discharge openings 28, while air is drawn inward through air vent tube 52 into the space in container 12 above fluid 60.

Figure 3B:
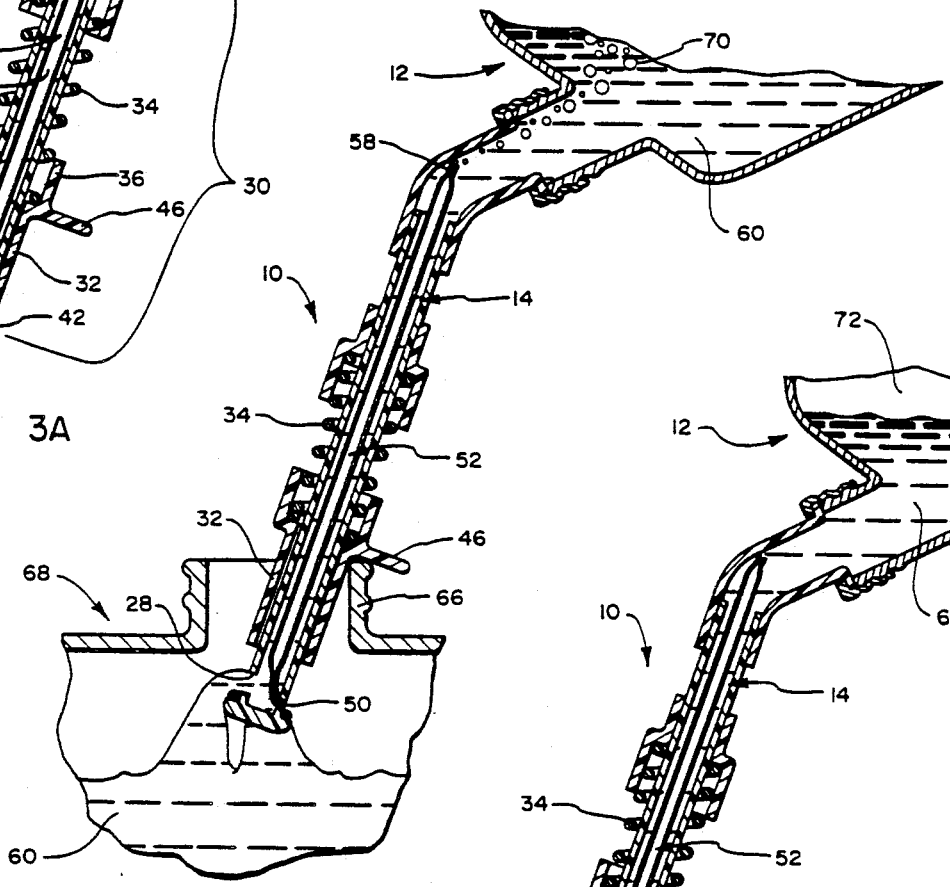
FIG. 3B is a cross-sectional view of the pour spout of FIG. 1 shown in a second stage of operation.

This dynamic state is depicted in FIG. 3B. There, projection 46 secured to sleeve 32 has engaged lip 66 of the opening to a receiving vessel 68 for fluid 60. As container 12 and pour spout 10 attached thereto are further advanced into receiving vessel 68, relative motion between sleeve 32 and fluid conduit 14 occurs, overcoming the bias of spring 34. In this process, it is normally adequate for the operator to merely rest pour spout 10 within receiving vessel 68, so that projection 46 engages lip 66 and then to permit the cumulative weight of container 12 with fluid 60 therein to descend compressing spring 34.

Support of the weight of container 12 in this manner would, however, suggest that pour spout 10, or at least fluid conduit 14 and slide 32 thereof, be made of a relatively sturdy material capable of bearing weight of such a magnitude. In instances where the use of pour spout 10 is contemplated with flammable fluids, a non-ferrous material, such as copper or sturdy plastic, is further recommended so as not to cause fluid-igniting sparks should pour spout 10 be struck accidentally against concrete or a ferrous material.

In any case, once sleeve 32 has been drawn toward container 12 exposing fluid discharge openings 28, fluid 60 will flow through these into receiving vessel 68, until sufficient back pressure is developed in space 72 above fluid 60 to substantially curtail continued fluid transfer, and then to induce air flow through air vent tube 52. Air drawn through air vent tube 52 into container 12, is indicated by bubbles 70 emerging from capillary section 58 of air vent tube 52. The back pressure above fluid 60 is maintained during the subsequent even flowing transfer of fluid during which time the volume of fluid flowing out of container 12 is substantially equal to the volume of air flowing thereinto through air vent tube 52. In this position of slide 32, any fluid 60 which seeped through fluid discharge openings 28 into interstitial space 62 or space 64 within spring retainer 36 will drain away into receiving vessel 68.

For the purpose of properly entrapping the bubble of air in air vent tube 52 when fluid container 12 is upturned, it has been found that the inner diameter of air vent tube 52 should be at least 1.5 times, and preferably at least 2.0 times, the inner diameter of any capillary sections therein, such as capillary sections 56, 58. In a pour spout having a fluid conduit 14 with an inner diameter of 0.50 inches and five fluid discharge openings 28 each having an inner diameter of 0.218 inches, capillary sections, such as capillary sections 56, 58, having inner diameters of 0.070 inches have proved entirely satisfactory when used with a container 12 holding gasoline.

The purpose of creating and maintaining back pressure above fluid 60 is to afford enhanced responsiveness in shutting of continued fluid flow when receiving vessel 68 becomes filled. When airflow through air vent tube 52 is terminated, the back pressure above the reservoir of fluid 60 causes fluid flow through fluid discharge openings 28 to cease almost simultaneously. No delay or passage of fluid out of conduit 14 is required in order to generate the back pressure above fluid 60 with which to terminate its flow. This back pressure is present with the pour spout of the present invention, even in the dynamic pouring state.

Figure 3C:
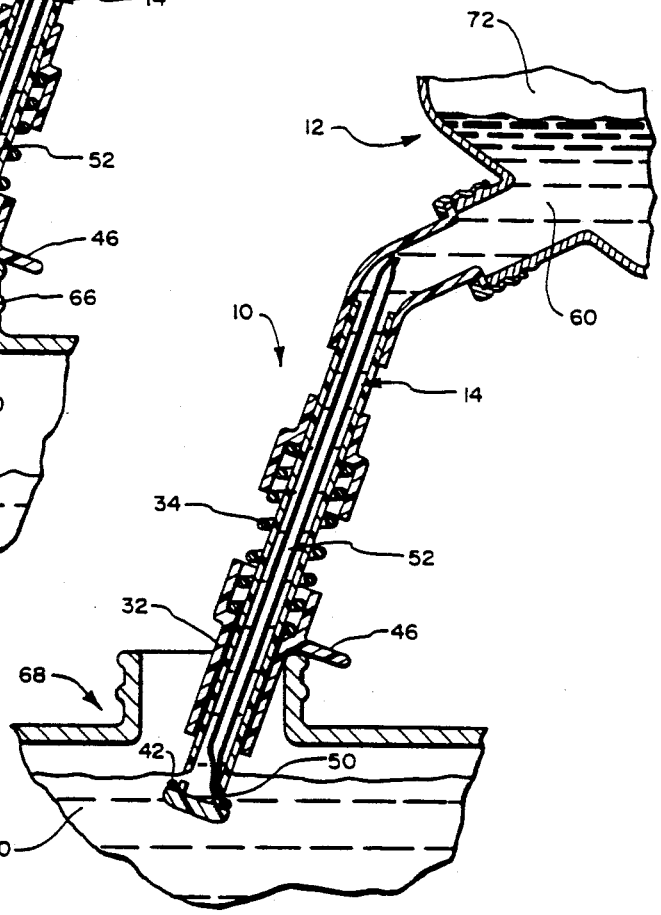
FIG. 3C is a cross-sectional view of the pour spout of FIG. 1 shown in a third and final stage of operation.

The stoppage of fluid flow is depicted in FIG. 3C. There, the level of fluid 60 in receiving vessel 68, has risen, due to the transfer of fluid 60, to a point at which fluid 60 obstructs air vent opening 50, thereby terminating air flow through vent tube 52 into the interior of container 12. The partial vacuum in space 72 above fluid 60 in container 12 exerts back pressure upon the further flow of fluid 60 from fluid conduit 14, and a condition of fluid stasis again results.

The operator of a pour spout, such as pour spout 10, need not peer into the opening into receiving vessel 68, or anxiously await the overflow of fluid 60 therefrom. Instead, after inserting pour spout 10 into receiving vessel 68, the operator can be secure in the knowledge that when receiving vessel 68 has filled with fluid 60 to the point that air vent opening 50 at the end of pour spout 10 is covered by fluid 60, all flow will stop. Thereafter, lifting of container 12 will remove pour spout 10 from receiving vessel 68, and the bias of spring 34 will return sleeve 32 into sealing engagement with O-ring 42. This thereafter prevents any loss of fluid from fluid discharge openings 28 during the time that container 12 is being returned to the upright.

Thus, the venting means of the present invention is one that not only admits air into the interior space within the container from which fluid is being dispensed after a negative pressure is developed thereabove, but the venting means also terminates air flow into the interior space when the receiving container for that fluid becomes filled. This effects a prompt curtailment of fluid flow through the fluid conduit into the receiving vessel. This overflow protection keeps excess fluid from emerging as overflow out of the receiving container.

The operation of an air vent tube, such as air vent tube 52, in conjunction with at least one capillary section, such as capillary sections 56 or 58, is so advantageous in venting of a container of fluid and in preventing overflow when fluid is transferred from that container into a receiving vessel, that such an air vent tube has utility in pour spouts, apart from the inclusion therein of any slide valve, such as slide valve 30. Under such circumstances, the air vent tube communicates between the space exterior to fluid conduit 14 at a location adjacent fluid discharge openings 28 and the interior space within container 12. Satisfactory venting and a limited form of overflow protection would then be available, provided that the end of fluid conduit 14 were located within the receiving vessel during the transfer of fluid and withdrawn therefrom in a quick motion simultaneously upturning container 12 once flow from container 12 had terminated. While a device of this type would not provide the complete spill protection afforded in pour spout 10 with slide valve 30, it would nevertheless be an improvement over some existing pour spout devices and is accordingly considered to be part of the inventive pour spout. In such a configuration, air vent tube 52 could for a substantial portion of its length also be located on the exterior of fluid conduit 14.

Figures 4, 4A:
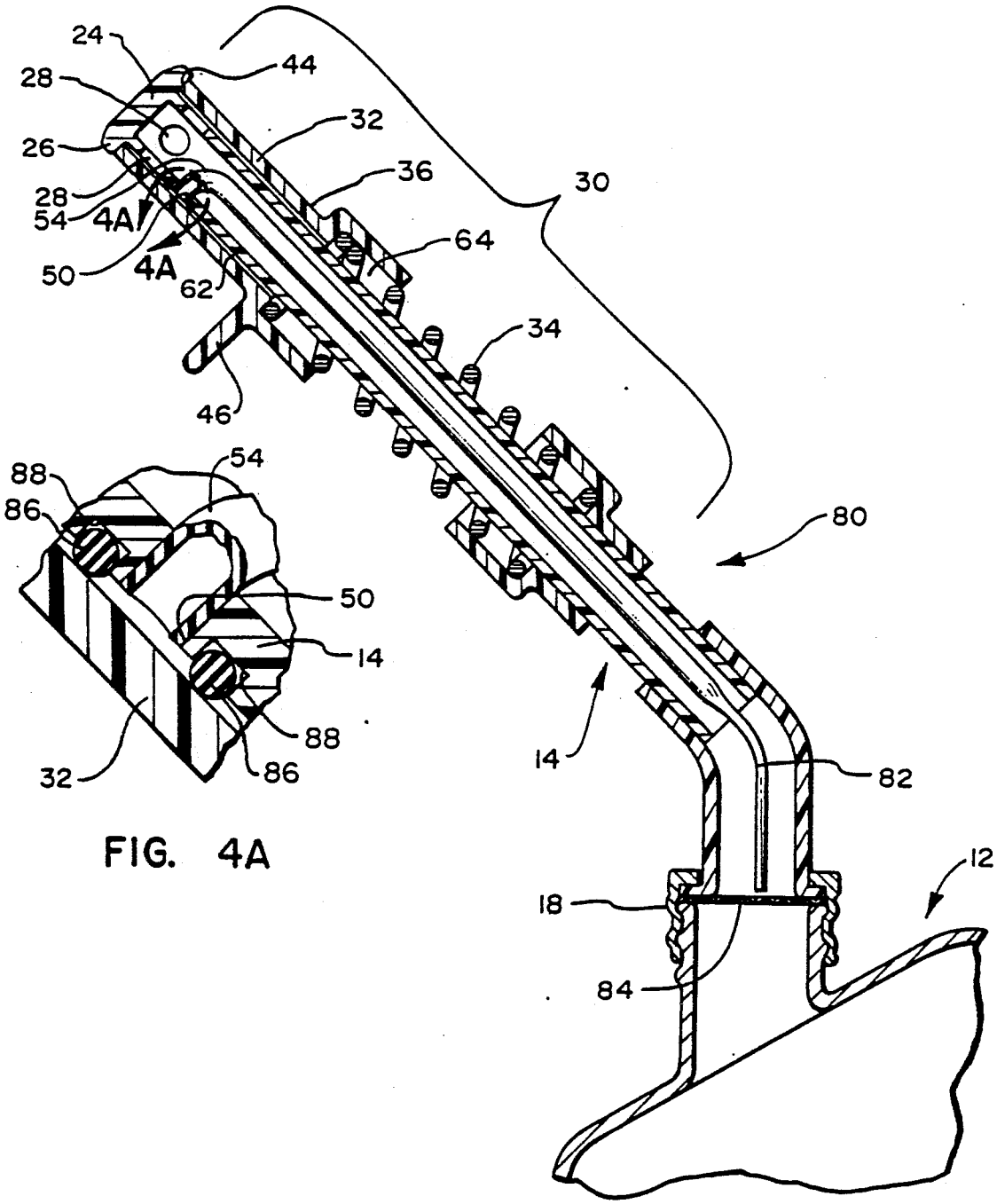
FIG. 4 is a cross-sectional view of a-second embodiment of a pour spout embodying teachings of the present invention.
FIG. 4A is an enlarged detail view of a portion of the pour spout shown in FIG. 4.

FIG. 4 depicts yet another embodiment of a pour spout 80 constructed according to the teachings of the present invention. Only the manner in which the structure of pour spout 80 distinguishes from that of pour spout 10 will be discussed, and identical structures will continue to be identified by the reference characters used in relation to the device of FIGS. 1 and 2. Pour spout 80 is shown removably attached to a container of fluid 12.

In contrast to pour spout 10, the leading edge 44 of sleeve 32 seats directly against lip 26 of end piece 24, which functions as the valve seat of slide valve 30. Also, air vent opening 50 is located closer to container 12 than are fluid discharge openings 28. This will have the effect of permitting fluid transferred into a receiving vessel to fill the receiving vessel higher in the neck of the opening thereinto than would a pour spout, such as pour spout 10, in which air vent opening 50 and fluid discharge openings 28 are at approximately the same longitudinal location on fluid conduit 14. In addition, air vent tube 52 in pour spout 80 is provided with only one capillary section 82, which while longer than corresponding capillary section 58 in FIG. 2, is still contained within the body of fluid conduit 14. The attachment of pour spout 80 to container 12 has been enhanced by the addition of a flash screen 84 to prevent entry of debris that might obstruct the proper functioning of capillary section 82.

As illustrated in FIG. 4, the end 54 of air vent tube 52 at air vent opening 50 does not narrow into a capillary section. Therefore, the fluid seal which develops in pour spout 10 at capillary section 56 when fluid container 12 is upturned to prevent the escape of air from fluid container 52, is not available in pour spout 80. In many instances, if the size of capillary section 82 is adequately small, this will not be a problem, as fluid seeping through fluid discharge openings 28 into interstitial space 62 between sleeve 32 and fluid conduit 14 will nonetheless fill air vent tube 52 at air vent opening 50 in due course, stopping the escape of air in that direction.

Even if a fluid seal at air vent opening 50 is effected, an air column in air vent tube 52 will not be securely entrapped, because the difference in internal cross section between end 54 of air vent tube 52 and capillary section 82 does not produce stasis. Rather, the pneumatic advantage created by those differing cross sections will gradually migrate the bubble of air in air vent tube 52 upward therein and possibly entirely out of capillary section 82. In theory, this process should only proceed to such a height as fluid 60 can rise in interstitial space 62 and space 64 within spring retainer 36.

Nevertheless, to prevent this, and to provide pour spout 80 with the full range of functional features found in pour spout 10, a mechanical, air tight seal may be provided at air vent opening 50 that closes air vent opening 50 at a point prior to or when sleeve 32 engages the valve seat of slide valve 30. Such an air tight seal could take the form of a resilient O-ring 86 retained in a groove 88 on the outer surface of fluid conduit 14 encircling air vent opening 50, as is illustrated in the detail to FIG. 4. Other forms of such a seal will be disclosed hereinafter.

Figures 5, 5A:
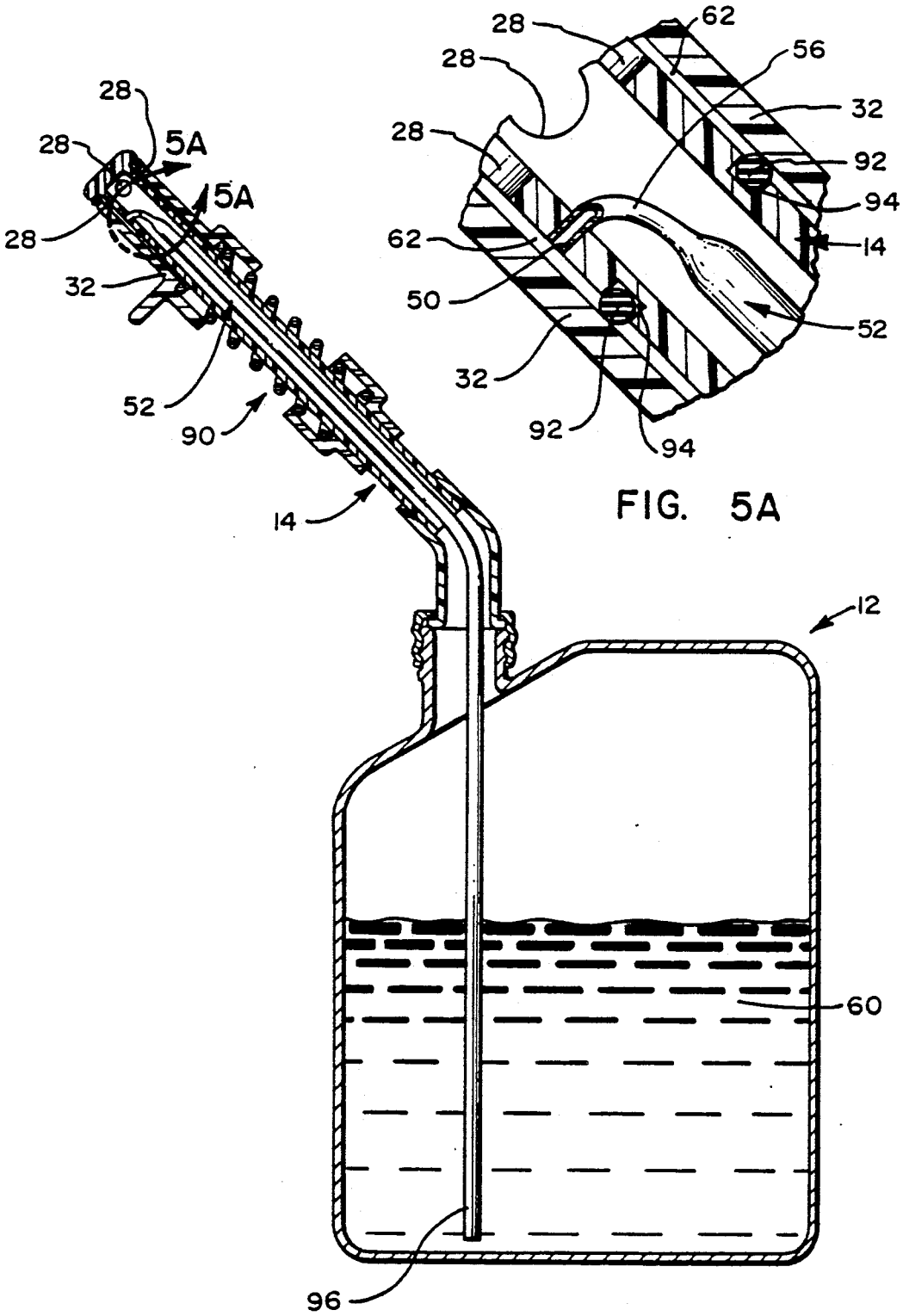
FIG. 5 is a cross-sectional view of a fluid container having attached thereto a third embodiment of a pour spout incorporating teachings of the present invention.
FIG. 5A is an enlarged detail view of a portion of the pour spout shown in FIG. 5.

Yet another embodiment of a pour spout 90 embodying teachings of the present invention is shown in FIG. 5 attached to a container 12 for fluid 60. Again, only the manner in which the structure of pour spout 90 differs from that of pour spout 10 will be discussed in any detail, and the structure of pour spout 90 identical to that of pour spout 10 will be referred to by correspondingly identical reference numerals.

As described earlier, when a container 12 using a pour spout according to the present invention is inverted, as in FIG. 3A, fluid 60 from within container 12 slowly seeps through fluid discharge openings 28 into the interstitial space 62 between sleeve 32 and fluid conduit 14, shown in the detail to FIG. 5. The possibility of fluid 60 in this manner ultimately escaping pour spout 90 can be entirely prevented by the provision of an auxiliary seal between sleeve 32 and the exterior surface of fluid conduit 14. Such an auxiliary seal can take the form of a resilient O-ring 92 retained in a groove 94 encircling fluid conduit 14 on the side of fluid discharge openings 28 and air vent opening 50 adjacent container 12. Such a sealed pour spout 90 would have the additional advantage of not venting container 12 were container 12 to be stored indoors containing a fluid 60 emitting objectionable vapors.

Air vent tube 52, as seen in FIG. 5A, is provided with a single capillary section 56 which is located at air vent opening 50 in the manner shown in FIG. 1. The end 96 of air vent tube 52 remote from air vent opening 50 does not contain any capillary section. This can be compensated for to a degree, if air vent tube 52 is extended beyond fluid conduit 14 into close proximity with the bottom 98 of container 12. Under most circumstances, when container 12 is inverted, end 96 of air vent tube 52 will be above the surface of fluid 60, and air vent tube 52 will function adequately to vent the interior space of container 12 when fluid is flowing out of fluid conduit 14.

A possibility for disfunction exists, however. As end 96 of air vent tube 52 extends into fluid 60 when container 12 is upright, a certain quantity of fluid 60 will be trapped in air vent tube 52 when container 12 with pour spout 80 attached thereto is inverted. If this quantity of fluid fills air vent tube 52 to precisely the height of the surface of fluid 60 in container 12 in that inverted position, then the head pressure, both at fluid discharge openings 28 and at air vent opening 50, will be equal. An air lock and a delayed initiation of fluid flow will result. Despite such disadvantageous functioning, pour spout 90 is in other respects adequately advantageous over known pour spouts, that the configuration shown in FIG. 5 is nevertheless considered to be within the scope of the inventive pour spout disclosed.

Figure 6:
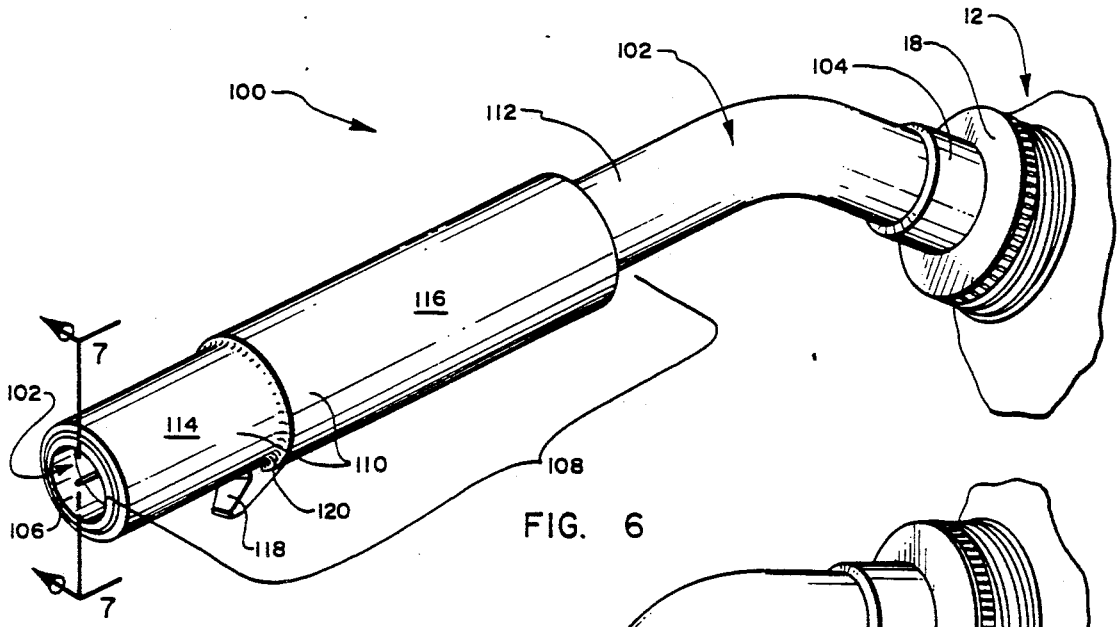
FIG. 6 is a perspective view of a fourth embodiment of a pour spout incorporating teachings of the present invention with the slide valve thereof in its closed position.

FIG. 6 depicts a fourth embodiment of a pour spout 100 incorporating teachings of the present invention. Pour spout 100 comprises a fluid conduit 102 having one end 104 thereof attached to container 12 using an annular, threaded cap 18 and a correspondingly threaded neck portion (not shown) of container 12. Alternatively, pour spout 100 may be fabricated with container 12 as an integral, non-removable portion thereof.

At the remote end 106, fluid conduit 102 is provided with fluid discharge openings not shown in FIG. 6 but disclosed in detail subsequently. Through such fluid discharge openings, the fluid in container 12 can be transferred into a receiving vessel. In accordance with one aspect of the present invention, a closure means is provided for precluding any such transfer of fluid from fluid conduit 102, until the fluid discharge openings thereof are inside the receiving vessel. The exterior of such a closure means is shown by way of example in FIG. 6 as comprising a slide valve 108 taking the form of a sleeve 110 closely conforming to the exterior surface 112 of fluid conduit 102 and mounted for sliding motion thereupon. In FIG. 6, slide valve 108 is shown in the closed position thereof in which transfer of fluid from fluid conduit 102 is precluded.

The end of sleeve 110 remote from container 12 takes the form of a tubular portion 114 which effects actual sliding contact with fluid conduit 102 and terminates flush with remote end 106 thereof in the closed position of slide valve 108. Integrally formed with tubular portion 114 is a cylindrical skirt portion 116 having a diameter enlarged in relation to that of tubular portion 114. As will be disclosed in relation to further figures, skirt portion 116 encloses and conceals a bias means for urging slide valve 108 into the closed position thereof illustrated in FIG. 6.

In accordance with another aspect of the closure means of the present invention, a slide valve release means is provided for coacting with a receiving vessel to move slide valve 108 out of the closed position as remote end 106 of fluid conduit 102 and the discharge openings therein, not shown in FIG. 6, enter into the receiving vessel. As shown by way of example and not limitation, a projection 118 is secured to sleeve 110 at a juncture 120 between tubular portion 114 and skirt portion 116. Projection 118 catches the lip of any receiving vessel into which fluid from container 12 is to be transferred. As remote end 106 of fluid conduit 102 is thereafter advanced into the receiving vessel, projection 118 draws sleeve 110 along the exterior of fluid conduit 102 towards container 12 and out of the closed position of slide valve 108.

Figure 7:
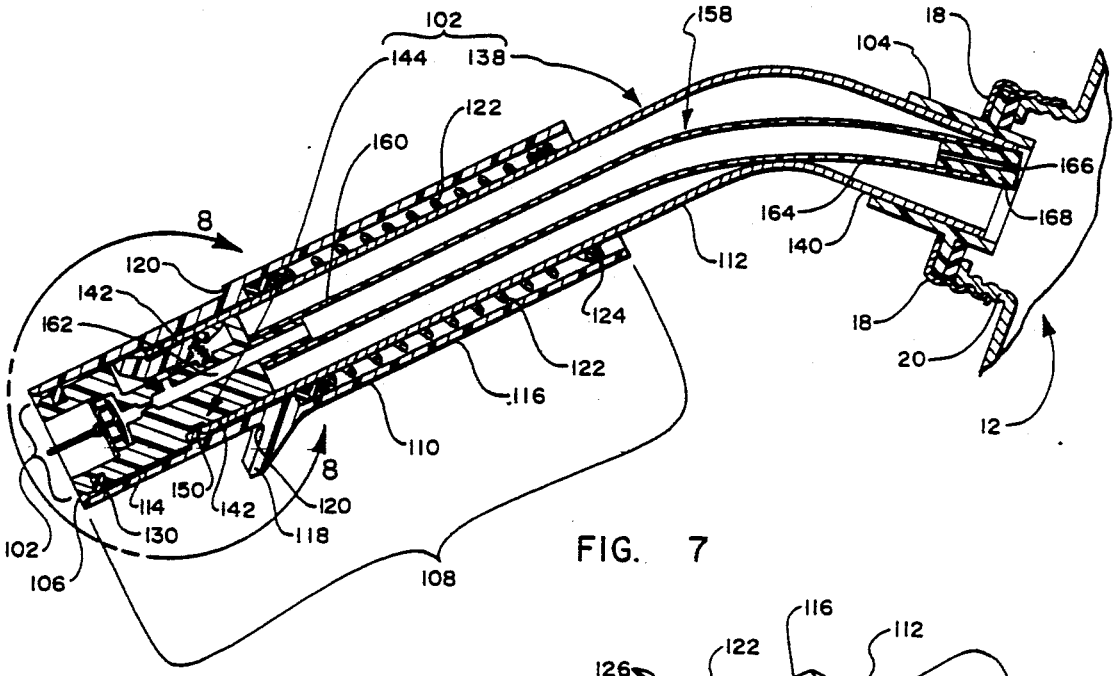
FIG. 7 is a cross-sectional elevation view of the full length of the pour spout shown in FIG. 6 taken along section line 7—7 therein.

These structures of the closure means of the present invention are shown to some additional advantage in FIG. 7 in relation to the internal construction of pour spout 100. A spring 122 encircles fluid conduit 102 inside of skirt portion 116 of sleeve 110 in compression between sleeve 110 and a spring-retaining collar 124 longitudinally fixed to exterior surface 112 of fluid conduit 102. As is more fully appreciated by reference to the enlargement contained in FIG. 8, the end of spring 122 remote from container 12 bears against a series of three washers 126 which are slidable upon exterior surface 112 of fluid conduit 102. Washers 126 in turn bear against an inside surface 128 of sleeve 110 at a point corresponding to juncture 120. In this manner, spring 122 urges sleeve 110 along fluid conduit 102 in a direction away from container 12.

Figure 8:
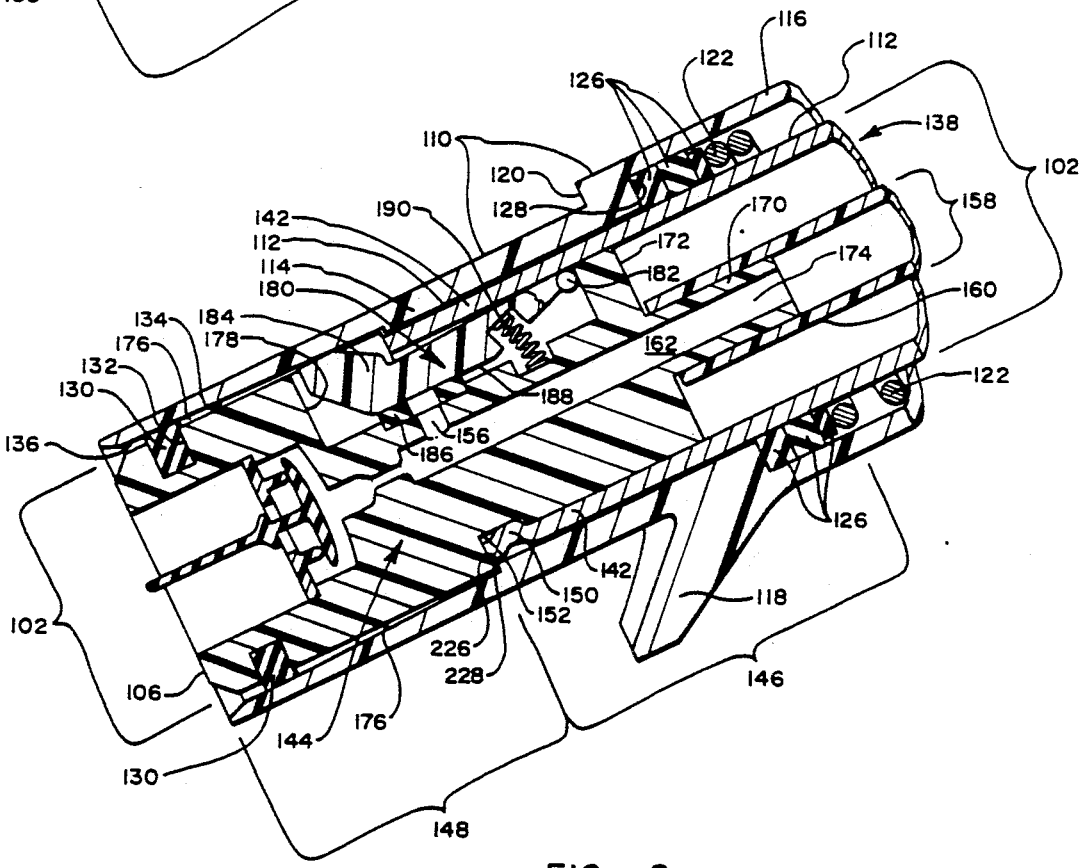
FIG. 8 is an enlarged detail cross-sectional elevation view of the tip of the pour spout illustrated in FIG. 7.

According to another aspect of the present invention, the closure means thereof further comprises a valve seat on fluid conduit 102 on the side of the fluid discharge openings remote from container 12. As shown by way of example in FIGS. 7 and 8, a resilient seal 130 retained on fluid-conduit 102 in a recessed groove 132 encircles fluid conduit 102 near the tip of remote end 106 thereof. Resilient seal 130 may comprise a lathe-cut seal, a square-ring seal, or even an O-ring made of a material that resists degradation from the type of fluid contemplated for use with pour spout 100 and container 12. In the closed position of slide valve 108, the inner surface 134 of tubular portion 114 of sleeve 110 encircles resilient seal 130 in sealing engagement therewith. Toward this end, the sealing portion 136 of inner surface 134 which engages resilient seal 130 may be provided with a slight outward taper as shown in FIG. 8.

Fluid conduit 102 may be fabricated as a unitary structure. A shown in FIG. 7, however, fluid conduit 102 advantageously comprises an open-ended conduit tube 138 having a first end 140 opening into container 12 and a second end 142 terminating within sleeve 110. Attached to and at least partially closing second end 142 of tube 138 is a fluid conduit end cap 144 which is preferably formed from a plastic material by a precision injection-molding technique. Together conduit tube 138 and end cap 144 comprise fluid conduit 102. As best understood from FIG. 8, end cap 144 comprises a first portion 146 which is inserted into second end 142 of conduit tube 138 and a second portion 148 which remains exterior thereto. End cap 144 is retained in conduit tube 138 by crimping the periphery 150 of second end 142 thereof into a crimping groove 152 recessed into the outside of first portion 146 of end cap 144. Alternatively, however, end cap 144 can be secured to tube 138 by other means, including diverse forms of bonding.

In accordance with another aspect of the present invention, venting means is provided for admitting air into the interior space within fluid conduit 102 and within container 12 to enable an even-flowing transfer of fluid from container 12. This occurs, however, only after an initial transfer of fluid through the discharge openings, without admitting air into the interior space, reduces the pressure of air in container 12 sufficiently below atmospheric pressure to substantially curtail continued transfer of fluid. Thus, back pressure is initially developed in container 12 while some fluid is transferred therefrom. As that back pressure increases to the point at which fluid transfer would cease or involve surges and gulps, the venting means of the present invention commences to admit air into container 12. This enables an even outflow of fluid to continue. This situation persists until either fluid conduit 102 is removed from the receiving vessel, closing slide valve 108, or until fluid in the receiving vessel rises to the level of fluid conduit 102. Thereupon, air flow into the interior space through the venting means of the present invention is terminated and fluid outflow from container 12 is promptly curtailed.

The abrupt stoppage of fluid outflow is essential if overflow of the receiving vessel is to be avoided. This object is attained through the cooperative action of airflow termination through the venting means and the existence of back pressure in container 12 throughout the entire pouring process. Were the back pressure to begin to be developed only at the time that the receiving vessel was approaching fullness, overflow protection would be uncertain. Before the cessation of fluid transfer could be achieved, the requisite back pressure would have to be developed. For this, an additional quantity of fluid would need to be transferred from fluid conduit 102; this additional quantity of fluid could cause the receiving container to overflow.

Figure 9:
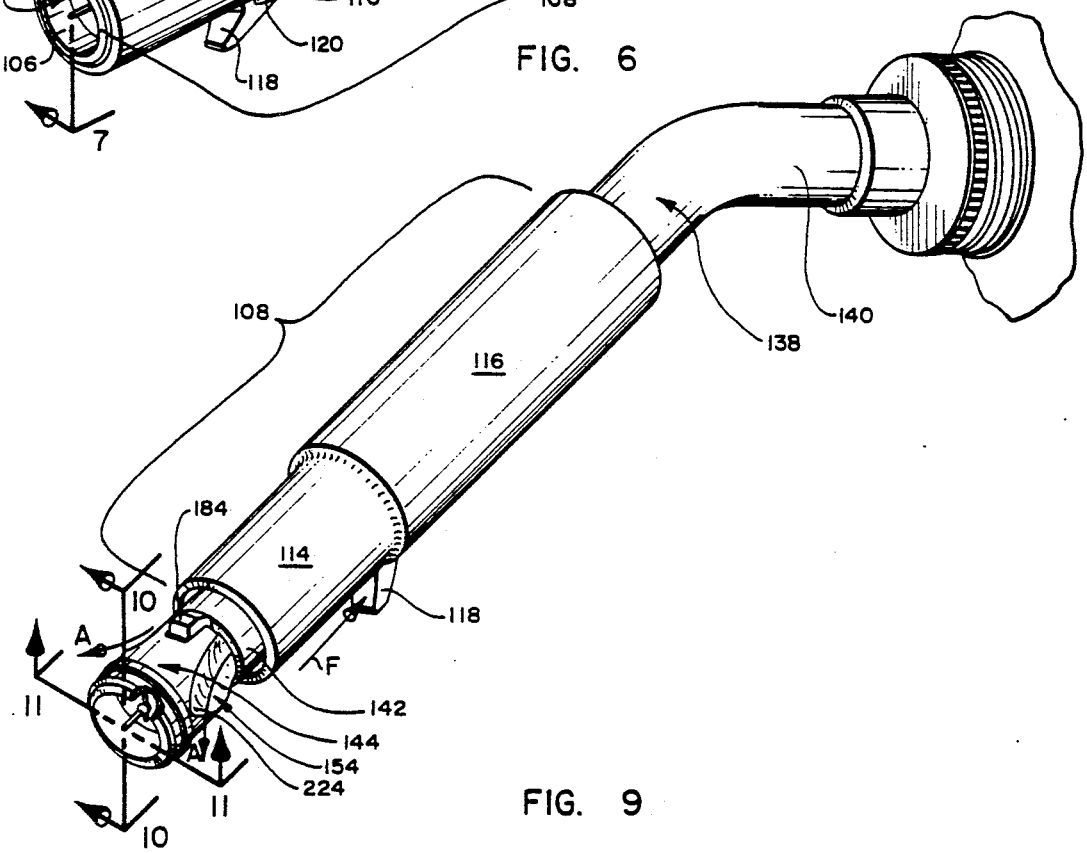
FIG. 9 is a perspective view of the pour spout of FIG. 8 with the slide valve thereof in its open position.

As was the case in the pour spouts disclosed above, the venting means of the present invention comprises an air vent tube communicating between the interior space and the exterior of fluid conduit 102 at a location which is inside the receiving vessel when the closure means described above ceases to preclude transfer of fluid from fluid conduit 102. This is the situation illustrated in FIG. 9, where a force indicated by arrow F applied to projection 118 has moved slide valve 108 out of the closed position thereon revealing second end 142 of conduit tube 138 and end cap 144 secured therein. Discharge openings 154, only one of which is visible in FIG. 9, then become free of obstruction, and fluid begins to be transferred from container 12 as indicated schematically by the arrows A. The structure of discharge openings 154 will be investigated in some detail below after a disclosure of the structure of the embodiment of venting means utilized with pour spout 100.

Figure 10:
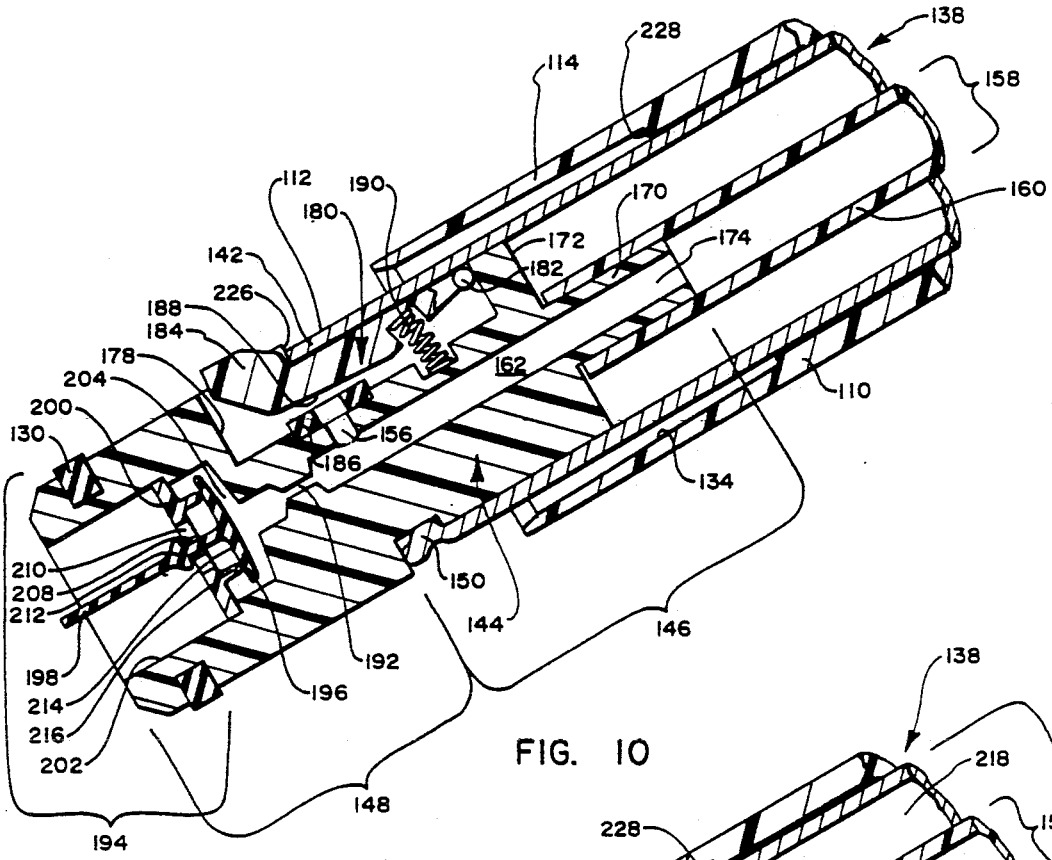
FIG. 10 is an enlarged detail cross-sectional elevation view of the tip of the pour spout illustrated in FIG. 9 taken along the section line 10—10 shown therein.

For this latter purpose, reference to FIG. 8, showing end cap 144 and slide valve 108 in the closed position thereof, in combination with FIG. 10, showing the same structure but with slide valve 108 out of the closed position thereof, will prove most helpful. As shown by way of example, an air vent opening 156 is formed in end cap 144 of fluid conduit 102 at a location which is inside the receiving vessel when slide valve 108 ceases to preclude transfer of fluid therefrom. An air vent tube 158 disposed within fluid conduit 102 communicates at a first end 160 thereof with air vent opening 156 through a first capillary section 162 having an inside diameter less than that of air vent tube 158.

As seen in FIG. 7, the second end 164 of air vent tube 158 in turn communicates with the interior space inside fluid conduit 102 and container 12 through a second capillary section 166. For ease of manufacture, second capillary section 166 is formed through a sleeve 168 which is inserted into second end 164 of air vent tube 158. In the alternative, second capillary section 166 or the equivalent thereof can be formed integrally with air vent tube 158, as in the case of capillary section 58 and air vent tube 52 shown in FIG. 2.

First capillary section 162 is formed in end cap 144 communicating with air vent opening 156. A stem 170 extends from face 172 of first portion 146 of end cap 144 within conduit tube 138. Centrally in stem 170 is the end 174 of first capillary section 162 remote from air vent opening 156. By sliding second end 164 of air vent tube 158 over stem 170, air vent tube 158 is rendered capable of communicating with air vent opening 156. Air vent tube 158 may be secured to sleeve 168 and stem 170 by adhesive, the pressure of the fit therebetween, or by any other suitable means. The sizes, relative and absolute of the diameters of first and second capillary sections 162, 166 and air vent tube 158 are as disclosed earlier in relation to capillary sections 56, 58 and air vent tube 52 shown in FIG. 2.

Second capillary section 166 primarily, and first capillary section 162 to a more limited extent, together function as an air vent tube constriction means for retarding the entry of fluid into air vent tube 158 when fluid is being transferred from container 12 to a receiving vessel. The manner in which this phenomena occurs and the advantages thereof are similar to those disclosed in relation to retention of a column of air in air vent tube 52 discussed in relation to FIGS. 3A, 3B, and 3C above.

As also discussed earlier, in relation to FIG. 3A, when container 12 with spout 100 attached thereto is inverted preparatory to pouring, fluid therefrom enters interstitial space 176 between sleeve 110 and fluid conduit 102. As the fluid in interstitial space 176 increases, the level thereof will rise until the fluid reaches air vent opening 156. Thereupon, the fluid will enter and begin to fill first capillary section 162 and thereafter air vent tube 158. This offers the undesirable potential for impairing the correct functioning of the air vent tube constriction means of the present invention to retain a column of air in air vent tube 158 during transfers of the fluid.

Accordingly, the air vent means of the present invention further comprises a closure means for preventing the entry of fluid into air vent take 158 from second end 164 thereof. As shown by way of example a seal is installed at air vent opening 156 for closing air vent opening 156 even when slide valve 108 is in the closed position thereof. In this manner, fluid in interstitial space 176 is precluded from entering or impairing the functioning of air vent tube 158 and first and second capillary sections 162, 166, respectively, for the intended purposes thereof. The nature and operation of this seal is best comprehended by a study of FIGS. 8 and 10 together. Air vent opening 156 is formed in a recess 178 in a side surface of end cap 144 which comprises contiguous surfaces of first portion 146 and second portion 148 of end cap 144. A lever 180 provided at one end thereof with an axle 182 is pivotally mounted in the portion of recess 178 located within first portion 146 of end cap 144 which is encircled by second end 142 of conduit tube 138. The end of lever 180 opposite from axle 182 extends into the portion of recess 178 formed in second portion 148 of end cap 144 and terminates there in an activation lobe 184. A resilient annular seal 186 encircles air vent opening 156 in the bottom of recess 178.

Lever 180 is capable of pivoting about axle 182 between a closed position shown in FIG. 8, blocking air vent opening 156, and an open position shown in FIG. 10 free thereof. In the closed position of lever 180, a rear surface 188 thereof sealingly engages resilient seal 186. A bias means taking the form of a spring 190 mounted between the bottom of recess 178 and rear surface 188 of lever 180 urges lever 180 into the open position thereof. In that open position, as shown in FIG. 10, activation lobe 184 extends beyond exterior surface 112 of fluid conduit 102. This can only occur when sleeve 110 of slide valve 108 is retracted into its own open position.

When sleeve 110 returns to the closed position of slide valve 108, inner surface 134 of tubular portion 114 of sleeve 110 forces activation lobe 134 into recess 178, overcoming spring 190, and pivoting lever 180 into the closed position thereof. In this manner, activation lobe 184 functions as a closure means on lever 180 for forcing lever 180 into the closed position thereof when slide valve 108 is in its own closed position. With lever 180 in the closed position thereof, fluid in interstitial space 176 cannot enter air vent tube 158 by way of air vent opening 156.

Alternatively, the same effect could be achieved by locating at first end 160 of air vent tube 158, or even at first capillary section 162, a seal that is capable of being closed when slide valve 108 is in its closed position. Such a seal would trap air in air vent tube 158, keeping fluid from entering thereinto by the then lower, first end 160 thereof. The seal at air vent opening 156 solves one problem, while creating another related to fluid in air vent tube 158 that is nevertheless also overcome in pour spout 100. Basically, any fluid in air vent tube 158 has difficulty in escaping therefrom, if a seal is provided at air vent opening 156. Fluid enters air vent tube 158 in two different manners.

Fluid enters air vent tube 158 when fluid in the receiving vessel reaches the level of air vent opening 156. Then air flow into container 12 is terminated. The back pressure in fluid container 12 developed at the onset of fluid transfer draws the fluid at air vent opening 156 into section 162 and up the full length of air vent opening 156. All air previously maintained in the air column in air vent tube 156 during fluid transfer is expelled to join the air in the top of container 12.

With the receiving vessel filled, fluid conduit 102 is then removed, and slide valve 108 closes, sealing air vent opening 156 with lever 180. The fluid drawn into air vent tube 158 cannot escape through air vent opening 156. When container 12 is set upright, air vent tube 158 is reversed in its orientation, but the fluid therein yet cannot escape through second capillary section 166 due to the absence of venting of air vent tube 158 to the atmosphere through air vent opening 156 with lever 180 in the closed position thereof. When the next fluid transfer from container 12 is attempted, no column of air will develop or be maintainable in air vent tube 158 and the functioning of pour spout 100 will be impaired.

Fluid will also enter air vent tube 158 through capillary section 166 at second and 164 of air vent tube 158 when container 12 is upturned to initiate a transfer of fluid. This fluid settles to the then lower end of air vent tube 158 adjacent to air vent opening 156 with the column of air in air vent tube 156 thereabove. Even with the seal in recess 178 at air vent opening 156 in the open position thereof, this fluid in the then lower portion of air vent tube 158 may be unable to escape from air vent tube 158 due to the bubbling action therethrough of air entering container 12 through air vent opening 156. If fluid conduit 102 is removed from the receiving vessel involved before the receiving vessel is filled, the action of slide valve 108 in forcing lever 180 into the closed position thereof seals air vent opening 158. The fluid cannot escape through air vent opening 156, and even when container 12 is returned to its upright position, reversing the orientation of air vent tube 158, the fluid that entered air vent tube 158 during fluid transfer process cannot escape therefrom back into container 12. The fluid moves to the then lower end, second end 164 of air vent tube 158. Due to the sealed condition of first end 160 of air vent tube 158, back pressure is created in air vent tube 158. This back pressure prevents the fluid in air vent tube 158 from draining through second capillary section 166. The presence of any substantial quantity of fluid impairs the correct functioning of air vent tube 158.

To alleviate these problems, the venting means of the present invention further comprises a relief means for draining fluid from air vent tube 158 after each transfer of fluid from container 12. As shown in FIG. 10, a relief passageway 192 communicates between air vent tube 158 and the exterior of fluid conduit 102 through first capillary section 162. In the course of relief, passageway 192 is a one-way relief valve means for admitting air into air vent tube 158 when the air pressure therein becomes less by a predetermined amount than ambient air pressure. This occurs whenever container 12 with pour spout 100 attached thereto is placed in the upright position thereof and fluid in air vent tube 158 attempts to drain therefrom through second capillary section 166. Naturally, where no seal is provided at air vent opening 156, this is not a problem.

As an example of such a relief valve means, an umbrella valve 194 is provided which preclude the escape of fluid or air from air vent tube 158 to the exterior of fluid conduit 102, but which permits air to enter thereinto when the pressure therein is less by a predetermined amount than ambient air pressure. Umbrella valve 194 comprises a flexible disk-shaped valve flap 196 integrally formed with a post 198 that extends centrally therefrom in the direction of the exterior of fluid conduit 102. A rigid disk 200 is used to form an umbrella valve chamber 204 that houses valve flap 196 and is in communication with relief passageway 192 at the bottom of a recess 202 in the tip of second portion 148 of end cap 144.

Centrally formed through disk 200 is an aperture 208 for receiving post 198 and branching therefrom slots 210 for serving as air passageways into chamber 204 when post 198 and valve flap 196 are installed. This is effected by an enlargement 112 on post 198 which together with post 198 is pulled through aperture 208 and slot 110 from the side of disk 200 facing relief passageway 192. Thereafter, enlargement 112 will not return through aperture 208 and slots 110. Post 198 between enlargement 112 and valve flap 196 is thereby placed in tension, bringing the sealing surface 214 of valve flap 196 into engagement with a circular lip 216 formed on the side of disk 200 facing relief passageway 192.

Figure 11:
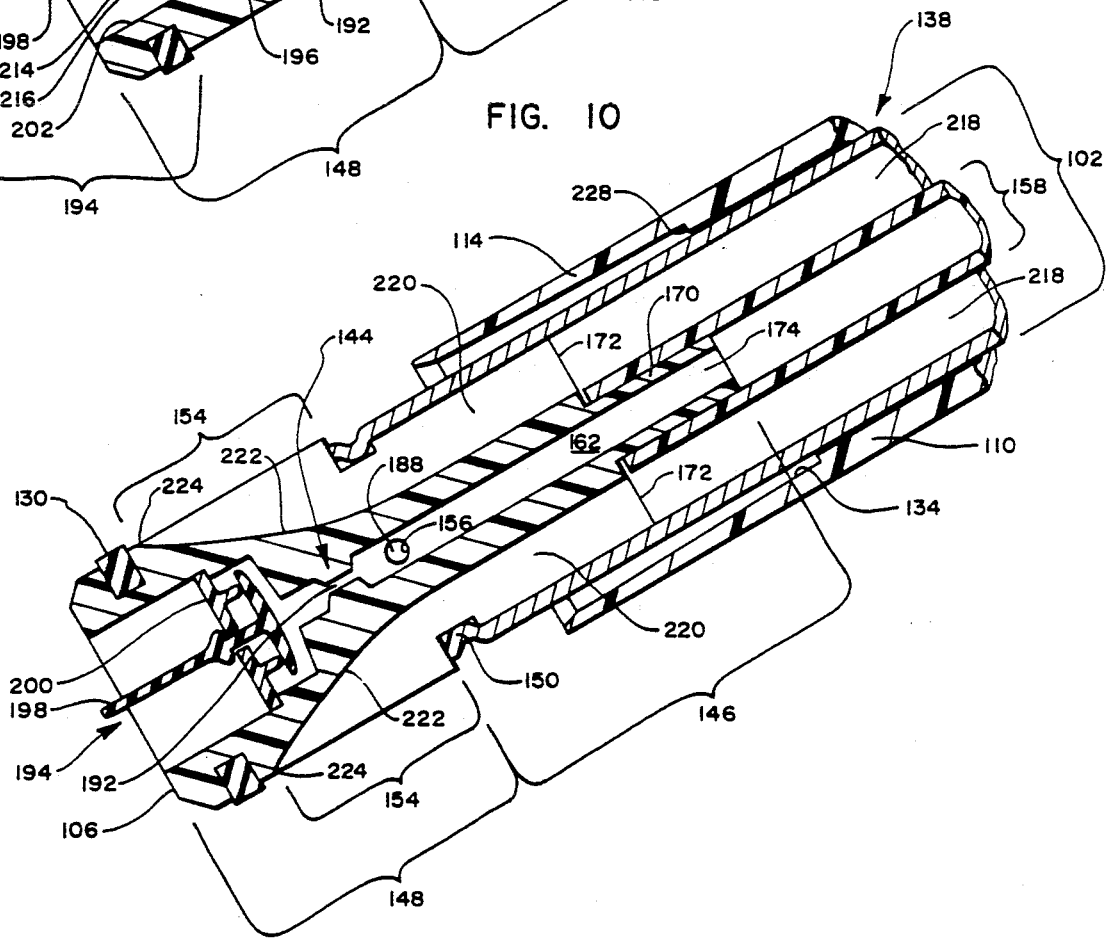
FIG. 11 is an enlarged detail cross-sectional view of the tip of the pour spout shown in FIG. 9 taken along the section line 11—11 shown therein.

FIG. 11 lends a fuller appreciation of the structure and functioning of discharge openings 154. Each discharge opening 154 communicates with the interior of fluid conduit 102 through a discharge passageway 220 formed in end cap 144 as an elongated recess parallel to the longitudinal axis of fluid conduit 102. Discharge passageway 220 traverses the full length of first portion 146 of end cap 144 and a section of second portion 148 contiguous therewith. That part of discharge passageway 220 formed in second portion 148 of end cap 144 terminates in discharge opening 154.

Advantageously, at the end of discharge passageway remote from container 12, the wall 222 of discharge passageway closest to the center of fluid conduit 102 turns outwardly from the center of end cap 144 and intersects the exterior thereof to form the edge 224 of discharge opening 154 remote from container 12. In this manner, fluid transferred through discharge passageway 220 and discharge opening 154 is imparted a substantial component of momentum away from container 212 and parallel to the longitudinal axis of fluid conduit 210. This eliminates splashing of the fluid from the receiving vessel by insuring that fluid being transferred from container 212 does not impact the walls or lip of the receiving vessel in a direction normal thereto.

Pour spout 100 presents an embodiment of the inventive pour spout which is easy to manufacture and assemble, but which is extremely precise and reliable in its operation and function. The use of an end cap, such as end cap 144, with a tubular section, such as conduit tube 138, to form the fluid conduit of the device is extremely advantageous. With the exception of the second capillary section 166 at inner or second end 164 of air vent tube 158, all fluid and air passageways of pour spout 100 are formed in end cap 44 in a single injection molding process. This includes not only discharge passageways 220 and the associated discharge openings 154, but air vent opening 156, first capillary section 162, relief passageway 192, and chamber 204 for umbrella valve 194 associated with draining fluid from air vent tube 158 after each transfer of fluid from container 12. Even resilient seal 130 associated with slide valve 108 and resilient seal 186 associated with lever 180 at air vent opening 156 may be precisely and securely installed by working directly only with end cap 144. This permits for highly efficient manufacturing and assembly.

In that assembly, spring 122, washers 126, and sleeve 110 are slid over conduit tube 138 in that order, and sleeve 110 is locked back in the open position thereof revealing second end 142 of conduit tube 138. Umbrella valve 194 is assembled by inserting post 198 through disk 200 and then pressing disk 200 into recess 202. Sleeve 168 is inserted in second end 164 of air vent tube 158 which is then in turn inserted over stem 170 extending from end cap 144. Resilient seals 130, 186 are installed on end cap 144. Lever 180 and spring 190 are assembled in recess 178. Then, end cap 144 with air vent tube 158 attached thereto is inserted into second end 142 of tube 138 and crimped or otherwise secured in place. As can be best appreciated in FIGS. 8 and 10, the outer diameter of second portion 148 of end cap 144 is somewhat larger than the outer diameter of second end 142 of conduit tube 138. This results in a stop 226 at the juncture between first and second portions 146, 148, respectively, of end cap 144 which arrests a catch 228 formed on inner surface 134 of tubular portion 114 of sleeve 110 in the closed position of slide valve 108. Stop 226 and catch 228 thus serve to retain sleeve 110 on fluid conduit 102 despite the urging of spring 122.

Figure 12:
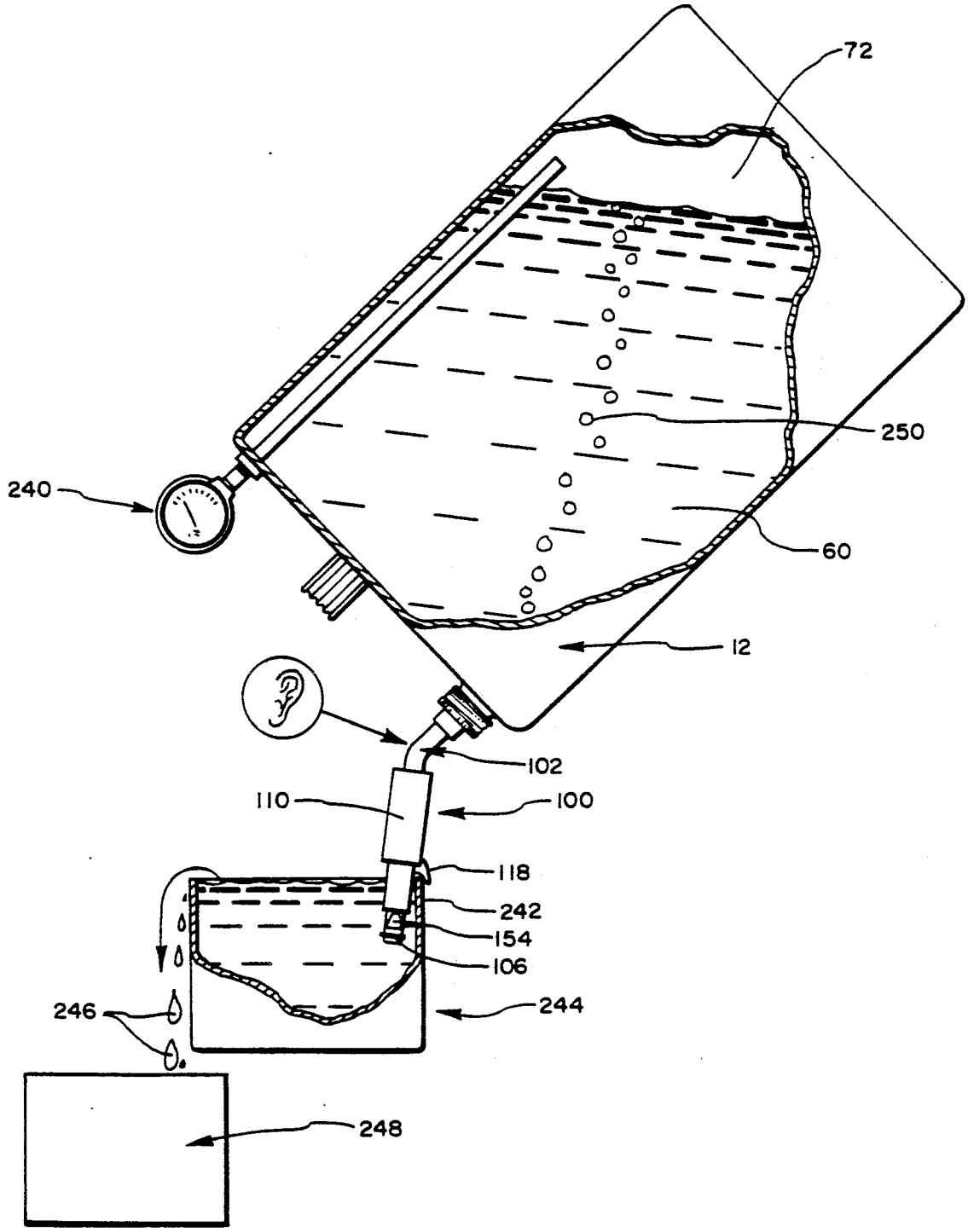
FIG. 12 is a diagram schematically illustrating one arrangement of equipment for investigating the operation of a pour spout embodying the teachings of the present invention.

FIG. 12 illustrates one arrangement of equipment which has been used to verify the manner in which the inventive pour spout functions to effect the surprisingly prompt termination of fluid transfer observed therewith. A container 12 of fluid 60 is fitted with an inventive pour spout, such as pour spout 100 discussed in relation to FIGS. 6–11. A pressure gauge 240 is attached to container 12 in such a manner as to be capable of measuring the back pressure developed in space 72 above fluid 60.

Container 12 is inverted and projection 118 on sleeve 110 is made to catch lip 242 of a receiving container 244. Thereafter, as fluid conduit 102 is advanced into receiving container 244, remote end 106 of fluid conduit 102 emerges from sleeve 110 and fluid begins to be transferred through discharge openings 154. If receiving container 244 is full at the onset of transfer, then the overflow 246 therefrom, which can be caught in a secondary receiving container 248, is an accurate measure of the amount of fluid that has been transferred. Auditory monitoring of fluid conduit 102 discloses the point in time at which bubbles 250 of air begin to be admitted through the venting means of pour spout 100 into the interior space within fluid conduit 102 and container 12.

Using the arrangement of equipment shown in FIG. 12, it has been verified that back pressure in the space 72 above fluid 60 is initially developed in an amount approximately equal to the fluid head pressure between the top surface of fluid 160 and discharge openings 154. This corresponds to the amount of back pressure required to substantially curtail continued transfer of fluid through discharge opening 154 after which without venting of container 12 the undesirable surges and gulping described earlier in the specification.

For a fluid conduit 102 comprising a tube 138 having an outer diameter of 0.875 inches and a wall thickness of 0.035 inches, the amount of fluid transferred from discharge opening 154 before bubbles 250 of air begin to be admitted into container 12 is shown below.

TABLE

| Nominal Size of Container 12 (gallons) | Quantity of Fluid in Container 12 at Outset (gallons) | Volume of Fluid Transferred Prior to Admission of Bubbles 250 of Air (oz) |
|---|---|---|
| 1.00 | 1.00 | 3.0 |
| | 0.50 | 3.3 |
| 2.50 | 2.50 | 3.0 |
| | 1.50 | 5.0 |
| | 0.50 | 5.5 |
| 5.00 | 5.00 | 4.0 |
| | 4.00 | 7.0 |
| | 3.00 | 9.0 |
| | 2.00 | 11.0 |
| | 1.00 | 12.0 |

The above experiments which were uniformly conducted using gasoline, illustrate that a number of variables including fluid depth, and container space unfilled by fluid effect the quantity of fluid transfer required to initiate venting by air 250. The density of the fluid being transferred can also be reasonably expected to impact the timing of the initiation of air admission, although this parameter was not directly tested.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A pour spout for permitting transfers from a container of fluid to a receiving vessel, the pour spout comprising:
   (a) a fluid conduit opening at one end thereof into the container of fluid, said fluid conduit being provided at a location remote from the container with a fluid discharge opening through which fluid from the container is transferred into the receiving vessel;
   (b) closure means for precluding any transfer of fluid through said discharge opening until said fluid discharge opening is inside the receiving vessel; and
   (c) venting means for admitting air into the interior space within said fluid conduit and within the container to enable an even-flowing transfer of fluid from the container after an initial transfer of fluid through said discharge opening without admitting air into said interior space reduces the pressure of air therein sufficiently below atmospheric pressure to substantially curtail continued transfer of fluid through said discharge opening, air flow into said interior space through said venting means terminating when the receiving vessel become filled with fluid, thereby effecting prompt curtailment of said continued transfer of fluid, said venting means comprising:
      (i) an air vent tube communicating between said interior space and the exterior of said fluid conduit at a location which is inside the receiving vessel when said closure means ceases to preclude transfer of fluid from said fluid conduit; and
      (ii) a capillary section located in said air vent tube having an inside diameter less than that of said air vent tube.

2. A pour spout as recited in claim 1, wherein said closure means comprises:
   (a) a slide valve having a closed position in which transfer of fluid through said discharge opening is precluded;
   (b) a spring urging said slide valve into said closed position thereof; and
   (c) slide valve release means for coacting with the receiving vessel to move said slide valve out of said closed position thereof when said fluid discharge opening on said fluid conduit enters into the receiving vessel.

3. A pour spout as recited in claim 2, wherein said slide valve comprises:
   (a) a sleeve closely conforming to the exterior surface of said fluid conduit and mounted for sliding motion thereupon; and
   (b) a valve seat on said fluid conduit on the side of said fluid discharge opening remote from the container of fluid, said sleeve being urged by said spring into sealing engagement with said valve seat in said closed position of said slide valve.

4. A pour spout as recited in claim 3, wherein said valve seat comprises a resilient seal encircling said fluid conduit on the side of said fluid discharge opening remote from the container of fluid, said seal being encircled by and in engagement with the inner surface of said sleeve in said closed position of said slide valve.

5. A pour spout as recited in claim 4, wherein said seal is a lathe-cut seal.

6. A pour spout as recited in claim 4, wherein said seal is a square ring seal.

7. A pour spout as recited in claim 4, wherein said seal is an O-ring.

8. A pour spout as recited in claim 4, wherein said slide valve release means comprises a projection secured to said sleeve for catching the receiving vessel and drawing said sleeve out of said closed position of said slide valve as said discharge opening on said fluid conduit enters the receiving vessel.

9. A pour spout as recited in claim 3, wherein said spring is disposed encircling said fluid and retained in compression between said sleeve and a longitudinally fixed point on said fluid conduit.

10. A pour spout as recited in claim 3, wherein said spring is disposed encircling said fluid conduit inside said sleeve, and wherein said spring is retained in compression between said sleeve and a longitudinally fixed point on said fluid conduit to urge said sleeve along said fluid conduit in a direction away from the container.

11. A pour spout as recited in claim 1, wherein said discharge opening communicates with the interior of said fluid conduit through a discharge passageway, and said discharge passageway and said fluid discharge opening are so configured that fluid transferred through said discharge opening is imparted a substantial component of momentum away from the container parallel to the longitudinal axis of said conduit.

12. A pour spout as recited in claim 11, wherein a first end of said discharge passageway communicates with said interior of said fluid conduit and is disposed parallel to the longitudinal axis thereof, and wherein at a second end of said discharge passageway opposite from said first end thereof the wall of said discharge passageway closest to the center of said fluid conduit turns outwardly from the center of said fluid conduit and intersects the exterior of said fluid conduit to form the edge of said discharge opening remote from said container.

13. A pour spout as recited in claim 1, wherein said fluid conduit comprises:

(a) a conduit tube having first and second open ends, said first end of said conduit tube opening into the container of fluid; and (b) a fluid conduit end cap attached to and at least partially closing said second end of said conduit tube, said end cap having formed therein said fluid discharge opening and a discharge passageway communicating from said discharge opening to the interior of said conduit tube.

14. A pour spout as recited in claim 13, wherein said end cap on the side of said fluid discharge opening remote from the container of fluid is encircled by a continuous groove in which to retain a resilient seal.

15. A pour spout as recited in claim 13, wherein said venting means communicates between said interior space and the exterior of said fluid conduit through said end cap.

16. A pour spout for permitting transfers from a container of fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel, said fluid conduit comprising:

(i) a conduit tube having first and second open ends, said first end of said conduit tube opening into the container of fluid; and (ii) a fluid conduit end cap attached to and at least partially closing said second end of said conduit tube, said end cap having formed therein said fluid discharge opening and a discharge passageway communicating from said discharge opening to the interior of said conduit tube, said end cap comprising a first portion which is inserted into said second end of said conduit tube and a second portion which is exterior thereto, and wherein an elongated recess disposed parallel to the longitudinal axis of said fluid conduit is formed along the full length of said first portion and along a section of said second portion contiguous therewith, the part of said recess formed in said first portion of said end cap in combination with the interior surface of said second end of said conduit tube functioning as said discharge passageway, and the part of said recess formed in said second portion of said end cap functioning as said discharge opening;

(b) closure means for precluding any transfer of fluid through said discharge opening until said fluid discharge opening is inside the receiving vessel; and (c) venting means for admitting air into the interior space within said fluid conduit and the container to enable an even-flowing transfer of fluid from the container after an initial transfer of fluid through said discharge opening without admitting air into said interior space reduces the pressure of air therein sufficiently below atmospheric pressure to substantially curtail continued transfer of fluid through said discharge opening, air flow into said interior space through said venting means terminating when the receiving vessel becomes filled with fluid, thereby effecting prompt curtailment of said continued transfer of fluid.

17. A pour spout for permitting transfers from a container of fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel;

(b) a slide valve having a closed position in which transfer of fluid through said discharge opening is precluded;

(c) bias means for urging said slide valve into said closed position thereof;

(d) slide valve release means for coacting with the receiving vessel to move said slide valve out of said close position thereof when said fluid discharge opening on said fluid conduit enters the receiving vessel;

(e) an air vent opening formed in said fluid conduit at a location which is inside the receiving vessel when said slide valve ceases to preclude transfer of fluid from said fluid conduit;

(f) an air vent tube communicating through said air vent opening between the interior space within said fluid conduit, the exterior of said fluid conduit; and (g) air vent tube constriction means located in said air vent tube remote from said air vent opening for retarding the entry of fluid into said air vent tube when fluid is being transferred from the container to the receiving vessel, thereby to retain a column of air in said air vent tube during transfer of the fluid.

18. A pour spout as recited in claim 17, further comprising a seal at said air vent opening for closing said air vent opening when said slide valve is in the closed position thereof.

19. A pour spout as recited in claim 17, wherein said air vent tube is disposed within said fluid conduit communicating at one end thereof with said air vent opening.

20. A pour spout for permitting transfers from a container of fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel;

(b) a slide valve having a closed position in which transfer of fluid through said discharge opening is precluded;

(c) bias means for urging said slide valve into said closed position thereof;

(d) slide valve release means for coacting with the receiving vessel to move said slide valve out of said closed position thereof when said fluid discharge opening on said fluid conduit enters the receiving vessel;

(e) an air vent tube communicating between the interior space within said fluid conduit and the exterior of said fluid conduit at a location which is inside the receiving vessel when said slide valve ceases to preclude transfer of fluid from said fluid conduit;

(f) air vent tube construction means for retarding the entry of fluid into said air vent tube when fluid is being transferred from the container to the receiving vessel, thereby to retain a column of air in said air in said air vent tube during transfer of the fluid, said air vent tube constriction means comprising a capillary section located in said air vent tube having an inside diameter less than that of said air vent tube.

21. A pour spout as recited in claim 20, wherein said capillary section is located at a second end of said air vent tube remote from said air vent opening.

22. A pour spout as recited in claim 20, wherein said inside diameter of said air vent tube is greater than or equal to about 1.5 times the inside diameter of said capillary section.

23. A pour spout as recited in claim 20, wherein the inside diameter of said air vent tube is greater than or equal to about two times the inside diameter of said capillary section.

24. A pour spout as recited in claim 20, wherein said venting means further comprises relief means for automatically draining fluid from said air vent tube after each transfer of the fluid.

25. A pour spout as recited in claim 24, wherein said relief means comprises:

(a) a relief passageway communicating between said air vent tube and the exterior of said fluid conduit; and (b) one-way relief valve means located in said relief passageway for admitting air into said air vent tube when the air pressure therein is less by a predetermined amount than ambient air pressure.

26. A pour spout as recited in claim 25, wherein said one-way relief valve means comprises an umbrella valve that precludes the passage of air or fluid from said air vent tube to the exterior of said fluid conduit.

27. A pour spout as recited in claim 26, wherein said relief passageway is formed through said end cap, and wherein said umbrella valve is housed in a relief valve chamber in said relief passageway.

28. A pour spout for permitting transfers from a container of fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel;

(b) a slide valve having a closed position in which transfer of fluid through said discharge opening is precluded;

(c) bias means for urging said slide valve into said closed position thereof;

(d) slide valve release means for coacting with the receiving vessel to move said slide valve out of said closed position thereof when said fluid discharge opening on said fluid conduit enters the receiving vessel;

(e) an air vent opening formed in said fluid conduit at a location which is inside the receiving vessel when said slide valve ceases to preclude transfer of fluid from said fluid conduit;

(f) an air vent tube communicating through said air vent opening between the interior space within said fluid conduit, the exterior of said fluid conduit; and (g) two capillary sections spaced apart and located in said air vent tube.

29. A pour spout as recited in claim 28, wherein a first of said two capillary sections is located at a first end of said air vent tube proximate to said air vent opening.

30. A pour spout as recited in claim 29, wherein said fluid conduit comprises:

(a) a conduit tube having first and second open ends, said first end of said conduit tube opening into the container of fluid; and (b) a fluid conduit end cap attached to and at least partially closing said second end of said conduit tube, said end cap having formed therein said fluid discharge opening and said air vent opening.

31. A pour spout as recited in claim 30, wherein said first of said two capillary sections is formed in said end cap, and wherein said air vent tube is attached to said first of said two capillary sections at the end thereof remote from said air vent opening.

32. A pour spout as recited in claim 30, wherein the surface of said end cap located opposite said slide valve when said slide valve is in the closed position thereof defines a side surface of said end cap, and wherein said venting means comprises a recess formed in said side surface, said air vent opening being formed in said recess, and wherein said venting means further comprises a seal at said air vent opening for closing said air vent opening when said slide valve is in the closed position thereof.

33. A pour spout as recited in claim 32, wherein said seal at said air vent opening comprises:

(a) a lever pivotally mounted in said recess for movement between a closed position blocking said air vent opening and an open position apart from said opening;

(b) bias means urging said lever into said open position thereof; and (c) closure means on said lever for forcing said lever into said closed position thereof when said slide valve is in the closed position thereof.

34. A pour spout as recited in claim 28, wherein a second of said two capillary sections is located at a second end of said air vent tube remote from said air vent opening.

35. A pour spout as recited in claim 34, wherein a sleeve inserted in said second end of said air vent tube and said second of said two capillary sections is formed through said sleeve.

36. A pour spout as recited in claim 35, further comprising a seal at said air vent opening for closing said air vent opening when said slide valve is in the closed position thereof.

37. A pour spout as recited in claim 28, wherein the inside diameters of said two capillary sections are substantially equal.

38. A pour spout as recited in claim 37, wherein the inside diameter of said air vent tube is greater than or equal to about 1.5 times the inside diameter of said capillary sections.

39. A pour spout as recited in claim 37, wherein the inside diameter of said air vent tube is greater than or equal to about two times the inside diameter of said capillary sections.

40. A pour spout as recited in claim 32, wherein said end cap comprises a first portion which is inserted into said second end of said conduit tube and a second portion which is exterior thereto, and wherein said recess is formed in a portion of said size surface comprising contiguous surfaces of said first and said second portions of said end cap.

41. A pour spout as recited in claim 40, wherein said closure means comprises an activation lobe formed on said lever and protruding from said second portion of said end cap out of said recess in said open position of said lever.

42. A pour spout as recited in claim 41, wherein said slide valve forces said activation lobe into said recess in the closed position of said slide valve.

43. A pour spout for permitting transfers from a container of fluid to a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel;

(b) an air vent opening formed in said fluid conduit at a location which is inside the receiving vessel when fluid is transferred therefrom into the receiving vessel;

(c) an air vent tube communicating at a first end thereof with the interior space within said fluid conduit and within the container and communicating at a second end thereof with said air vent opening;

(d) air vent tube constriction means for retarding the entry of fluid into said air vent tube when fluid is being transferred from the container to the receiving vessel, thereby to retain a column of air in said air vent tube during transfers of the fluid, said air vent tube constriction means comprising a capillary section located in said air vent tube having an inside diameter less than that of said air vent tube.

44. A pour spout as recited in claim 43, wherein said capillary section is located at said first end of said air vent tube.

45. A pour spout as recited in claim 43, wherein said air tube constriction means comprises two capillary sections spaced apart and located in said air vent tube.

46. A pour spout as recited in claim 45, wherein a first of said two capillary sections is located at said first end of said air vent tube.

47. A pour spout as recited in claim 46, further comprising relief means for draining fluid from said air vent tube after each transfer of the fluid.

48. A pour spout as recited in claim 43, further comprising relief means for automatically draining fluid from said air vent tube after each transfer of the fluid.

49. A pour spout as recited in claim 48, wherein said relief means comprises:

(a) a relief passageway communicating between said air vent tube and the exterior of said fluid conduit; and (b) one-way relief valve means located in said relief passageway for admitting air into said air vent tube when the air pressure therein is less by a predetermined amount than ambient air pressure.

50. A pour spout as recited in claim 49, wherein said relief valve means comprises an umbrella valve that precludes passage of air or fluid from said air vent tube to the exterior of said fluid conduits.

51. A pour spout as recited in claim 43, wherein said fluid conduit comprises:

(a) a conduit tube having first and second open ends, said first end of said conduit tube opening into the container of fluid; and (b) a fluid conduit end cap attached to and at least partially closing said second end of said conduit tube, said end cap having formed therein said fluid discharge opening and said air vent opening.

52. A pour spout as recited in claim 51, further comprises relief means formed in said end cap for draining fluid from said air vent tube after each transfer of the fluid.

53. A pour spout as recited in claim 43, further comprising closure means for precluding any transfer of fluid through said discharge opening until said fluid discharge opening is inside the receiving vessel.

54. A pour spout for permitting transfer from a container of fluid into a receiving vessel, the pour spout comprising:

(a) a fluid conduit opening at one end thereof into the container of fluid, said fluid conduit being provided at a location remote from the container with a fluid discharge opening through which fluid from the container is transferred into the receiving vessel;

(b) a slide valve having a closed position in which transfer of fluid through said discharge opening is precluded;

(c) a spring for urging said slide valve into said close position thereof;

(d) slide valve release means for coacting with the receiving vessel to move said slide valve out of said closed position thereof once said fluid discharge opening on said fluid conduit enters into the receiving vessel;

(e) an air vent opening formed in said fluid conduit at a location which is inside the receiving vessel when said slide valve ceases to preclude transfer of fluid from said fluid conduit;

(f) an air vent tube communicating at a first end thereof with the interior space within said fluid conduit and within the container and communicating at a second end thereof with said air vent opening; and (g) a capillary section located in said air vent tube having an inside diameter less than that of said air vent tube.

55. A pour spout as recited in claim 54, wherein said fluid conduit comprises:

(a) a conduit tube having first and second open ends, said first end of said conduit tube opening into the container of fluid; and (b) a fluid conduit end cap attached to and at least partially closing said second end of said conduit tube, said end cap having formed therein said fluid discharge opening and said air vent opening.

56. A pour spout as recited in claim 54, further comprising closure means for preventing entry of fluid into said air vent tube from said second end thereof when said slide valve is in said closed position thereof.

57. A pour spout as recited in said claim 56, wherein said closure means comprises a seal at said air vent opening for closing said air vent opening when said slide valve is in the closed position thereof.

58. A pour spout as recited in claim 54, further comprising relief means for automatically draining fluid from said air vent tube after each transfer of the fluid.

* * * * *

UNITED STATES PATENT AND TRADEMARK OFFICE

CERTIFICATE OF CORRECTION

PATENT NO. : 5,076,333

DATED : December 31, 1991

INVENTOR(S) : VERL LAW

It is certified that error appears in the above-identified patent and that said Letters Patent is hereby corrected as shown below:

Column 1, line 65, delete "in"
Column 2, line 22, "increase" should be --increases--
Column 4, line 50, delete "for"
Column 6, line 3, "fluidsealing" should be --fluid-sealing--
Column 7, line 51, "commenced" should be --commences--
Column 9, line 19, "an" should be --any--
Column 11, line 54, "of" should be --off--
Column 13, line 15, "FIG. 4" should be --FIG. 4A--
Column 13, line 41, "air tight" should be --airtight--
Column 13, line 44, "air tight" should be --airtight--
Column 13, line 63, "shown in the detail to FIG. 5." should be --shown in detail at FIG. 5.--
Column 14, line 20, "disfunction" should be --dysfunction--
Column 15, line 58, "tube 138" should be --conduit tube 138--
Column 18, line 67, "and 164" should be --end 164--
Column 19, line 60, "enlargement 112" should be --enlargement 212--
Column 19, line 62, "slot 110" should be --slot 210--
Column 19, line 63, "enlargement 112" should be --enlargement 212--
Column 19, line 64, "slot 110" should be --slot 210--
Column 19, line 65, "enlargement 112" should be --enlargement 212--
Column 20, line 24, "container 212" should be --container 12--

UNITED STATES PATENT AND TRADEMARK OFFICE

CERTIFICATE OF CORRECTION

PATENT NO. : 5,076,333

DATED : December 31, 1991

INVENTOR(S) : VERL LAW

It is certified that error appears in the above-identified patent and that said Letters Patent is hereby corrected as shown below:

Column 21, lines 32-36, delete "This corresponds to the amount of back pressure required to substantially curtail continued transfer of fluid through discharge opening 154 after which without venting of container 12 the undesirable surges and gulping described earlier in the specification." and insert therefor --This corresponds to the amount of back pressure which is required to substantially curtail continued transfer of fluid through discharge opening 154, and after the establishment of which, without venting of container 12, the undesirable surges and gulping described earlier in the specification will occur.--

Column 22, line 29, "vessel become" should be --vessel becomes--
Column 23, line 16, after "fluid" insert --conduit--
Column 27, line 15, after "sleeve" insert --is--
Column 28, line 9, "air tube" should be --air vent tube--

Signed and Sealed this

Twelfth Day of October, 1993

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,076,333
DATED : December 31, 1991
INVENTOR(S) : Verl Law

It is certified that error appears in the above-identified patent and that said Letters Patent is hereby corrected as shown below:

On the cover page, in the section entitled "Notice", on the second line, change "May 30, 2006" to --March 16, 2007--.

Signed and Sealed this

Thirteenth Day of July, 1999

*Attest:*

*Attesting Officer*

Q. TODD DICKINSON

*Acting Commissioner of Patents and Trademarks*